US009291984B2

(12) United States Patent
Moriya et al.

(10) Patent No.: US 9,291,984 B2
(45) **Date of Patent: *Mar. 22, 2016**

(54) CONNECTOR FOR HEATER, AND FIXING APPARATUS

(71) Applicant: CANON KABUSHIKI KAISHA, Tokyo (JP)

(72) Inventors: Jiro Moriya, Numazu (JP); Takayuki Mizuta, Numazu (JP); Hideki Ohta, Numazu (JP); Yoshisuke Kasuya, Susono (JP); Kazushi Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/606,479

(22) Filed: Jan. 27, 2015

(65) Prior Publication Data

US 2015/0139680 A1 May 21, 2015

Related U.S. Application Data

(63) Continuation of application No. 13/891,550, filed on May 10, 2013, now Pat. No. 8,995,868.

(30) Foreign Application Priority Data

May 11, 2012 (JP) ..... 2012-109321
May 11, 2012 (JP) ..... 2012-109322
Dec. 4, 2012 (JP) ..... 2012-265482

(51) Int. Cl.
*G03G 15/20* (2006.01)
*G03G 15/00* (2006.01)
*G03G 21/16* (2006.01)

(52) U.S. Cl.
CPC ..... *G03G 15/80* (2013.01); *G03G 15/2017* (2013.01); *G03G 21/1652* (2013.01); *G03G 2215/2035* (2013.01)

(58) Field of Classification Search
CPC ..... G03G 21/1652; G03G 15/2017; G03G 2215/2035
USPC ..... 399/90, 330
See application file for complete search history.

(56) References Cited

U.S. PATENT DOCUMENTS 6,275,669 B1 8/2001 Hasegawa
8,649,699 B2 2/2014 Kajita
8,995,868 B2 * 3/2015 Moriya et al. ..... 399/90
2011/0058861 A1 3/2011 Suzuki (Continued)

FOREIGN PATENT DOCUMENTS

JP 2000-268902 A 9/2000
JP 2000-294319 A 10/2000

(Continued)

OTHER PUBLICATIONS

Jan. 5, 2016 Office Action in counterpart Japanese Patent Application No. 2012-109322.

*Primary Examiner* — Hoang Ngo
(74) *Attorney, Agent, or Firm* — Fitzpatrick, Cella, Harper & Scinto

(57) ABSTRACT

An image fixing apparatus for heating and fixing an unfixed image formed on a recording material, comprising a heater including a substrate, a first electrode provided on one side of the substrate and a second electrode provided on the other side of the substrate; and a connector, connected with the heater, for receiving electric power, the connector including an electrically insulative housing, and a contact terminal provided inside the housing and having first spring contact contacted to the first electrode and a second spring contact contacted to the second electrode, wherein the contact terminal is swingable relative to the housing.

15 Claims, 19 Drawing Sheets

(56) References Cited

U.S. PATENT DOCUMENTS

| | | | |
|---|---|---|---|
| 2011/0103808 | A1 | 5/2011 | Abe et al. |
| 2011/0103809 | A1 | 5/2011 | Kuwata et al. |
| 2013/0195532 | A1 | 8/2013 | Abe et al. |

FOREIGN PATENT DOCUMENTS

| | | | |
|---|---|---|---|
| JP | 2004-214056 | A | 7/2004 |
| JP | 4585668 | B2 | 11/2010 |
| JP | 2012-84406 | A | 4/2012 |

* cited by examiner (a)

(b)

CONNECTOR FOR HEATER, AND FIXING APPARATUS

CROSS-REFERENCE TO RELATED APPLICATION

This application is a Continuation of U.S. application Ser. No. 13/891,550, filed May 10, 2013, and allowed on Oct. 27, 2014, and which claims priority from Japanese Patent Applications Nos. 109321/2012, 109322/2012 and 265482/2012 filed May 11, 2012, May 11, 2012 and Dec. 4, 2012, respectively, which are all hereby incorporated by reference.

FIELD OF THE INVENTION AND RELATED ART

The present invention relates to a fixing apparatus (device) for an image forming apparatus, and a connector for supplying the fixing apparatus (device) with electric power.

An apparatus having a combination of an endless belt and a ceramic heater which is in contact with the inward surface of the endless belt has been put to practical use as a fixing apparatus for thermally fixing a toner image formed on a sheet of recording medium, to the sheet of recording medium. A ceramic heater used by such an apparatus has a ceramic substrate, a heat generating member, and electrodes which are in electrical connection with the heat generating member. The heater is held by a heater holder made of resin. It is to the electrode(s) of the heater that a connector for supplying the heater with electric power is connected.

The connector is provided with a terminal (or terminals), which is within the connector. In order to ensure that the terminal of the power supply connector remain satisfactorily connected with the electrodes of the heater, it is necessary for a preset amount of contact pressure to be maintained between the terminal of the power supply connector and the heater electrodes.

The connector disclosed in Japanese Patent No. 4585668 has a terminal having a pair of spring contacts which sandwich a heater as the connector is engaged with the electrodes of the heater. One of the spring contacts plays the role of an electrical contact which contacts the electrode of the heater, whereas the other (support spring) plays the role of keeping the heater pressed toward the heater holder, with the presence of a spacer between itself and the heater.

The connector is structured so that the contact pressure between the spring support and the heater (spacer) becomes greater than the contact pressure between the spring contact (as electrical contact) and the electrode. Thus, it does not occur that the heater separates from the heater supporting surface of the heater holder. Therefore, the connector disclosed in the abovementioned Japanese Patent is higher in the level of accuracy, than a conventional connector, in terms of the positional relationship between the electrodes of the heater and the terminal of the connector, which in turn can keep the spring contacts of the connector stable in the amount by which the points of contact of the spring contacts are displaced, or the angle by which they are bent. With the spring contacts being kept stable in the amount by which the points of contact are displaced, or the angle by which the spring contacts are bent, the contact pressure between the spring contacts of the connector, and the electrodes, one for one, of the heater, remain stable at a preset, desired, level. Thus, this connector is suitable as a connector for a fixing device, the heater of which is attached to the heater holding surface of the heater holder so that the heat generating member of the heater faces the heater holding surface.

However, in a case where the connector disclosed in Japanese Patent No. 4585668 is used as the connector for a heater having a heater or heaters, on both of the primary surfaces of its ceramic substrate (this heater will be referred to as "two-sided heater", hereafter), it is possible that the contact pressure between one of the spring contacts of the connector terminal and the electrode of the heater on the top surface, for example, of the two-sided heater will become different from the contact pressure between the other spring contact of the connector terminal and the corresponding electrode of the heater. If the contact pressure between one of the spring contacts of the connector terminal and the electrode of the heater on the top surface of the two-sided heater is substantially different from the contact pressure between the other spring contact of the connector terminal and the corresponding electrode, the two-sided heater is subjected to a substantial amount of stress. Thus, in order to prevent the ceramic substrate of the two-sided heater from being broken by the stress, the connector is designed so that it is as small as possible in the amount of the stress which it imparts to the ceramic substrate of the heater.

Therefore, the two sides of a two-sided heater have to be made the same in the amount of contact pressure between the electrode of the heater and the spring contact of the terminal of the connector for the heater. Further, a connector for a two-sided heater is structured so that when it is engaged with a two-sided heater, its two spring contacts come into contact with the electrodes of the heater in such a manner that they oppose each other with the presence of the electrode of the two-sided heater between them. Thus, the amount of displacement of the point of contact of each spring contact when the connector is engaged with the two-sided heater is affected by the thickness of the substrate of the heater. For example, if the substrate of the two-sided heater is reduced in thickness, the amount of displacement of the point of contact of the spring contact of the connector also decreases.

Further, if a two-sided heater, the substrate of which is very thin, deviates in position because of the tolerance for heater components, and/or the components related to the heater, the point of contact of the spring contact of the connector sometimes separates from the heater, resulting in unsatisfactory fixation attributable to the interruption of the electric power supply to the heater. In order to prevent the occurrence of this problem, the components related to a heater (two-sided heater in particular) are required to have a high level of accuracy in measurement, which possibly reduces the yield of the mass-production of the aforementioned components.

SUMMARY OF THE INVENTION

Thus, the primary object of the present invention, which was made in consideration of the above described issue, is to provide a connector which can engage with the electrode of a heater in such a manner that as the connector is engaged with the electrode of the heater, a preset (proper) amount of contact pressure is generated and maintained between the electrode of a heater and the spring contact of the connector, and also, to provide a fixing apparatus (device) which has such a connector.

According to an aspect of the present invention, there is provided an image fixing apparatus for heating and fixing an unfixed image formed on a recording material, comprising: a heater including a substrate, a first electrode provided on one side of said substrate and a second electrode provided on the other side of the substrate; and a connector, connected with the heater, for receiving electric power, the connector including an electrically insulative housing, and a contact terminal provided inside the housing and having first spring contact contacted to the first electrode and a second spring contact contacted to the second electrode, wherein the contact terminal is swingable relative to the housing.

According to another aspect of the present invention, there is provided an electrical connector for electric power supply, the connector comprising: an electrically insulative housing; and a contact terminal provided inside the housing and including a first spring contact for contacting to a first electrode provided on one side of a heater substrate and a second spring contact for contacting to a second electrode provided on the other side of the substrate. The contact terminal is swingable relative to the housing.

According to a further aspect of the present invention, there is provided an image fixing apparatus for heating and fixing an unfixed image formed on a recording material, comprising: a heater including a substrate, and an electrode provided on the substrate; a connector, connected with the heater, for receiving electric power, the connector including an electrically insulative housing, and a contact terminal provided inside the housing and having spring contact contacted to the electrode, a holder holding the heater. The contact terminal is provided, at a position opposing the spring contact, with a projection cooperating with the spring contact to nip the holder, and the contact terminal is swingable with a fulcrum at the projection.

According to a further aspect of the present invention, there is provided an electrical connector for electric power supply, the connector comprising an electrically insulative housing; and a contact terminal provided inside the housing and including a spring contact for contacting to an electrode provided on heater. The contact terminal is provided, at a position opposing the spring contact, with a projection cooperating with the spring contact to nip a holder for holding the heater, and the contact terminal is swingable with a fulcrum at the projection.

According to a further aspect of the present invention, there is provided an image fixing apparatus for heating and fixing an unfixed image formed on a recording material, comprising: a heater including a substrate, and an electrode provided on the substrate; a connector, connected with the heater, for receiving electric power, the connector including an electrically insulative housing, and a contact terminal provided inside the housing and having spring contact contacted to the electrode. A hook shaped portion is provided by two surfaces perpendicular to each other, between the fulcrum of swing and a contact portion of the spring contact contacting to the electrode.

According to a further aspect of the present invention, there is provided an electrical connector for electric power supply, the connector comprising: electrically insulative housing; and a contact terminal provided inside the housing and including a spring contact for contacting to an electrode of a heater. A hook shaped portion is provided by two surfaces perpendicular to each other, between the fulcrum of swing and a contact portion of the spring contact contacting to the electrode.

Further features of the present invention will become apparent from the following description of exemplary embodiments (with reference to the attached drawings).

DESCRIPTION OF THE PREFERRED EMBODIMENTS

[Embodiment 1]

First, a connector in accordance with the present invention, and a fixing apparatus (device) having this connector, in this embodiment, are concretely described.

<Image Forming Apparatus>

Figure 9:
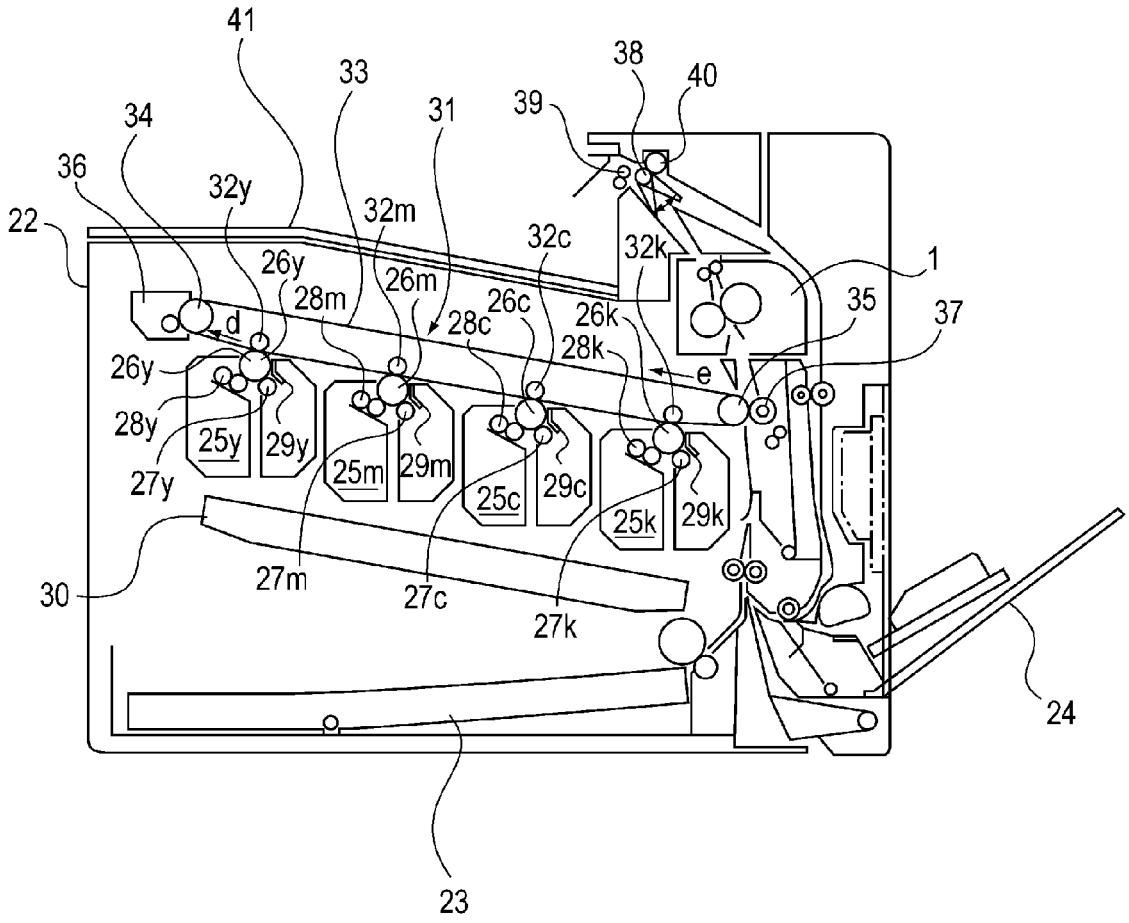
FIG. 9 is a schematic sectional view of a typical image forming apparatus which is compatible with the present invention. It shows the structure of the apparatus.

This embodiment is described with reference to an electrophotographic color image forming apparatus having four photosensitive drums. FIG. 9 is a vertical sectional view of a full-color laser beam printer 22 (which hereafter will be referred to simply as "printer"). It shows the general structure of the printer 22.

Referring to FIG. 9, the printer 22 is provided with a recording medium feeder cassette 23, which is removably stored in the bottom portion of the printer 22. It is also provided with a manual feed tray 24 for manually feeding recording medium into the printer 22. The tray 24 is on the right side (in FIG. 9) of the printer 22. The printer 22 is structured so that multiple sheets of a recording medium, placed in layers in the recording medium feeder cassette 23, or on the manual feed tray 24, are fed one by one into the main assembly of the printer 22 while being separated from the rest. The printer 22 is designed to employ four means for forming a toner image on a sheet of a recording medium, more specifically, four cartridges 25*y*, 25*m*, 25*c* and 25*k* for forming yellow, magenta, cyan, and black toner images, respectively.

The cartridges 25*y*, 25*m*, 25*c* and 25*k* are provided with photosensitive drums 26*y*, 26*m*, 26*c* and 26*k* (as the image bearing member, collectively and individually referred to as the photosensitive drum 26), and charging apparatuses (devices) 27*y*, 27*m*, 27*c* and 27*k*, respectively, for uniformly and negatively charging the photosensitive drums 26*y*, 26*m*, 26*c* and 26*k*. They are also provided with development rollers 28*y*, 28*m*, 28*c* and 28*k*, respectively, for adhering toner to an electrostatic latent image to develop the latent image into a toner image, that is, a visible image formed of toner. They are also provided with cleaning blades 29*y*, 29*m*, 29*c* and 29*k*, respectively, for removing the toner remaining on the peripheral surface of the photosensitive drums 26*y*, 26*m*, 26*c* and 26*k*.

The printer 22 is also provided with a scanner (scanning unit) and an intermediary transfer unit 31, which are in the adjacencies of the four cartridges. The scanner 30 forms an electrostatic latent image on the peripheral surface of each photosensitive drum 26 by projecting a beam of laser light upon the peripheral surface of the photosensitive drum 26, while modulating the beam according to the information of the image to be formed.

The intermediary transfer unit 31 has four primary transfer rollers 32*y*, 32*m*, 32*c* and 32*k*, an intermediary transfer belt 33, a driver roller 34, and an idler roller 35. It forms a unit by being combined with a cleaning device 36 for removing the transfer residual toner remaining on the intermediary transfer belt 33. The intermediary transfer belt 33 is an endless (cylindrical) belt, and is suspended by the driver roller 34 and idler roller 35. The idler roller 35 is grounded. It is kept pressured by an unshown pressure applying means in the direction indicated by an arrow mark d in FIG. 9, providing thereby the intermediary transfer belt 33 with a preset amount of tension.

As the driver roller 34 is rotationally driven by an unshown motor or the like, the intermediary transfer belt 33 is circularly moved in the direction indicated by an arrow mark e in FIG. 9, at a preset speed. As for the primary transfer, positive voltage (bias) is applied to the primary transfer rollers 32*y*, 32*m*, 32*c* and 32*k* to use the difference in potential level between the positive voltage applied to the primary transfer rollers and the negatively charged peripheral surface of the photosensitive drums 26*y*, 26*m*, 26*c* and 26*k*.

After the transfer (primary transfer) of the toner images from the photosensitive drums 26 onto the intermediary transfer belt 33, in the nips formed between the primary transfer roller 32 and photosensitive drums 26, the toner images on the intermediary transfer belt 33 are transferred onto a sheet of a recording medium, in the secondary transfer station 37. Then, the sheet of the recording medium, on which the toner images have just been borne, is processed by the fixing device 1, and the toner images are fixed to the sheet of the recording medium. Designated by a reference numeral 38 is a flapper for switching the direction in which a sheet of the recording medium is to be conveyed after the fixation of the toner images on the sheet of the recording medium. More specifically, the flapper 38 guides the sheet of the recording medium toward a pair of discharge rollers 39, or to a switchback roller 40. As the sheet S of the recording medium is guided toward the switchback roller 40, it is conveyed backward by the switchback roller 40, being thereby conveyed through the secondary transfer station 37 and the fixing device 1, and then, is guided toward the discharge rollers 39. Then, it is discharged into a delivery tray 41 by the discharge rollers 39 (through nip between two rollers 39).

<Fixing Apparatus (Device)>

Figure 1:
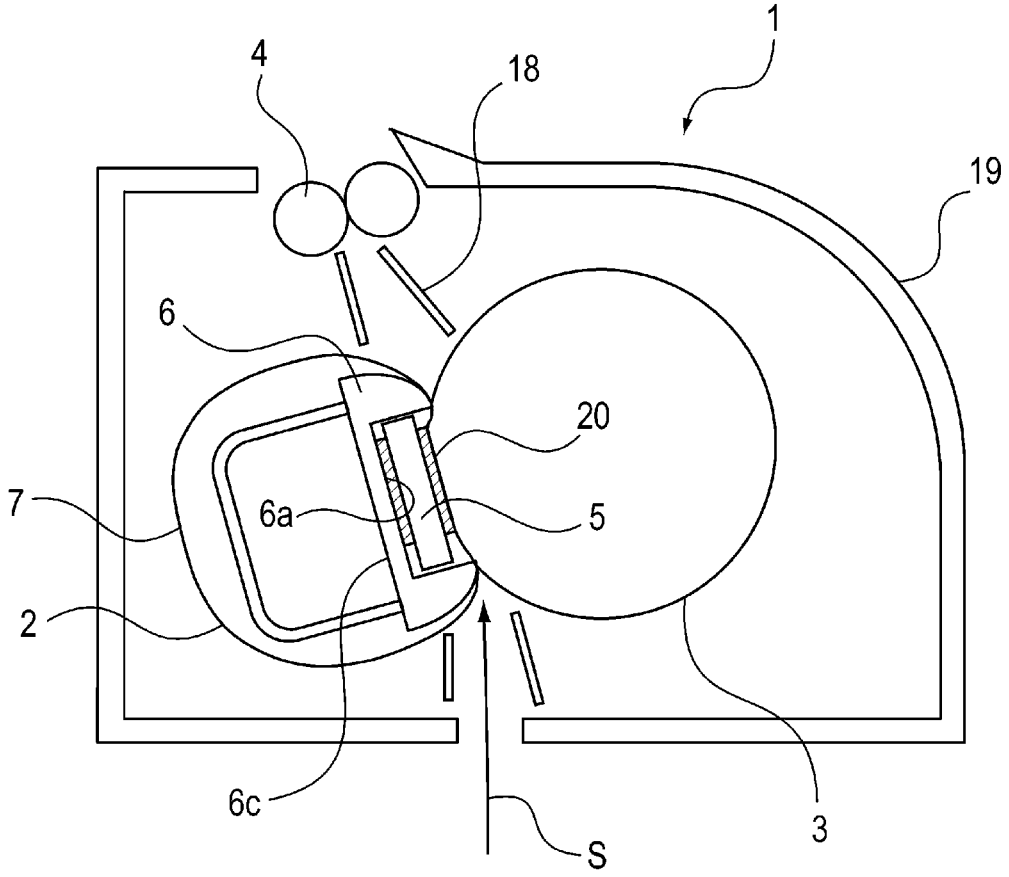
FIG. 1 is a schematic sectional view of a typical fixing apparatus to which the present invention is applicable. It shows the general structure of the fixing apparatus.

Next, referring to FIG. 1, the fixing device 1 which is employed by an image forming apparatus, such as a laser beam printer, is described regarding its structure. FIG. 1 is a sectional view of the fixing device 1 in this embodiment. The fixing device 1 has a heating unit 2, a pressure roller 3, a sheet conveyance roller 4, a sheet guide 18, a housing 19, etc. There is a fixation nip 20 between the heating unit 2 and pressure roller 3. After the transfer of the toner images onto a sheet S of the recording medium, the sheet S is conveyed through the fixation nip 20 while remaining pinched between the heating unit 2 and pressure roller 3.

Figure 3:
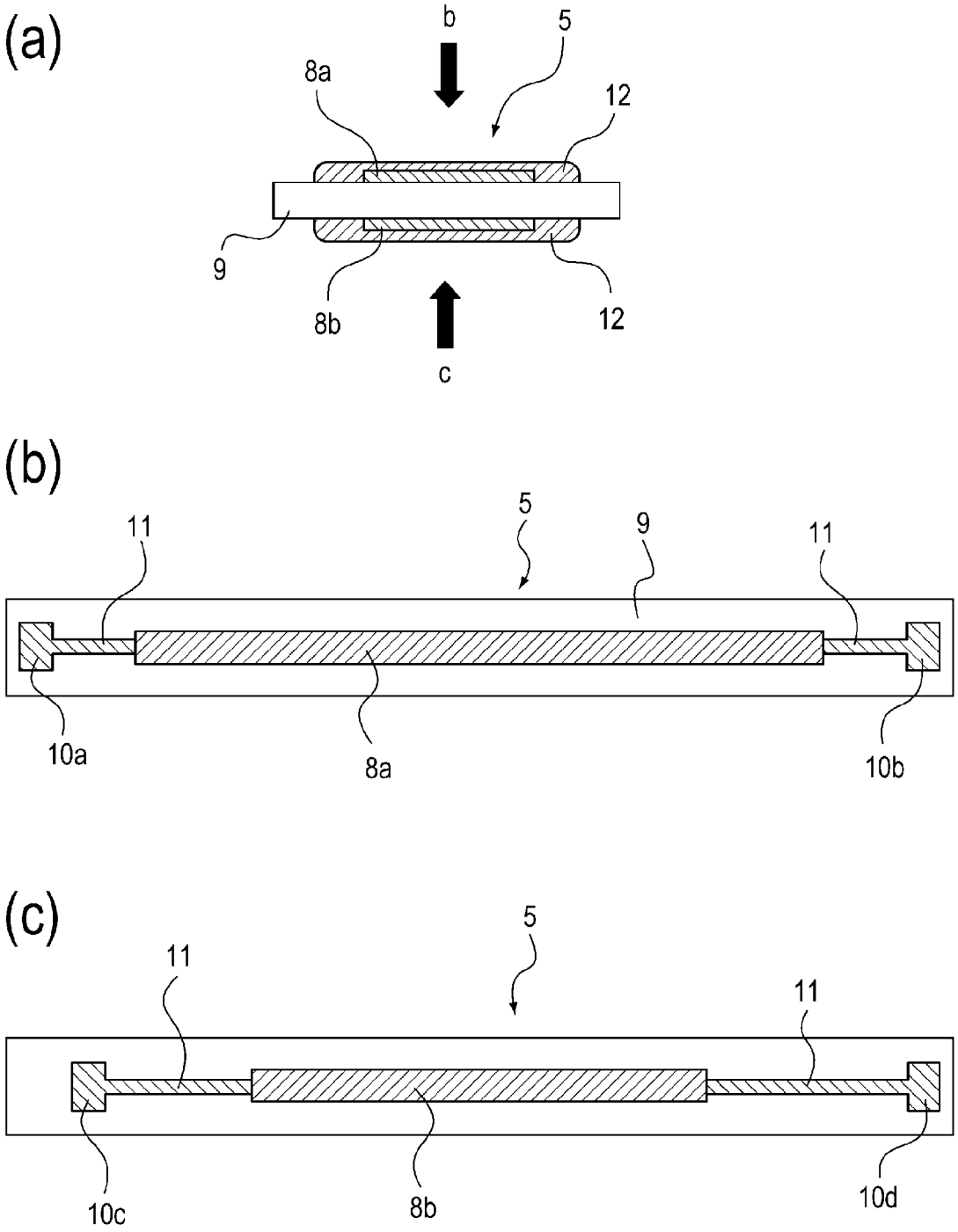
FIGS. 3(*a*)-3(*c*) are drawings for showing the structure of the heater.

The heating unit 2 has a cylindrical film 7 (endless belt), a heater 5, and a heater supporting member 6 (heater holder) which supports the heater 5. Referring to FIGS. 3(*a*)-3(*c*), the heater 5 has a pair of heat generating members 8*a* and 8*b*, which are provided on the front and rear surfaces, one for one, of a dielectric substrate 9. The heating unit 2 has also a pair of electrodes 10*a*, 10*b*, which are positioned at the lengthwise end portions (FIG. 3(*b*) of one of the primary surfaces of the substrate 9, one for one, and a pair of electrodes 10*c* and 10*d*, which are positioned at the lengthwise end portions (FIG. 3(*c*)) of the other primary surface of the substrate 9, one for one.

The heat generating members 8*a* and 8*b*, which are on the front and rear surfaces, one for one, of the substrate 9, are different in dimension in terms of the lengthwise direction (left and right directions in FIGS. 3(*b*) and 3(*c*)). The length of each of the heat generating members 8*a* and 8*b* is set according to the size (width) of a sheet S of the recording medium to be conveyed through the fixation nip 20 of the fixing device 1.

The layout of the electrodes 10*a*-10*d* is as follows.

The electrodes 10*b* and 10*d* provided on the front and rear surfaces, one for one, at the same lengthwise end portions (right end portion in FIGS. 3(*b*) and 3(*c*)) of the substrate 9, are positioned so that they overlap with each other in terms of the lengthwise direction of the substrate 9 (as seen from direction perpendicular to substrate 9). Further, the electrodes 10*a* and 10*c* which are provided on the front and rear surfaces, one for one, at the same lengthwise end portions (left end portion in FIGS. 3(*b*) and 3(*c*)) of the substrate 9, and through which the heat generating members are supplied with electric power, are positioned so that they do not overlap with each other in terms of the lengthwise direction of the substrate 9 (as seen from direction perpendicular to substrate 9).

It is to the electrodes of the heater 5 that the connector for supplying the heater with electric power is connected. More specifically, it is to the electrodes 10*b* and 10*d* that the connector 13 having two spring contacts, which correspond to electrodes 10*b* and 10*d*, one for one, is connected. FIGS. 4-8 are drawings for showing the structure of this connector 13. It is also to the electrodes 10*a* and 10*c* that the connector 13 is connected. That is, in this embodiment, three connectors 13 are used. One of the two spring contacts in the connector to be connected to the electrode 10*a* contacts the portion of the heater substrate 9, which does not have an electrode. Therefore, it does not play a role of supplying the heater 5 with electric power. This is also true with the connector that is to be connected to the electrode 10*c*. A connector, both of the two spring contacts of which contact the electrode of the heater 5, is the connector 13 having the two spring contacts which contact the electrodes 10*b* and 10*d*, one for one, of the heater 5. Next, the structure of the connector 13 is described with reference to the connector 13, which is to be connected to the electrodes 10*b* and 10*d*.

The connector 13 is made up of a dielectric housing 15, and a terminal 14 (shown in FIGS. 5-8) fitted in the housing 15. Referring to FIG. 7, as the connector 13 is attached to the combination of the heater 5 and a heater supporting member, a pair of spring contacts 16*a* and 16*b* of the terminal 14 come into contact with, and press on, the electrodes 10*b* and 10*d*, respectively, generating thereby a preset amount of contact pressure between the spring contacts 16*a* and 16*b* and the electrodes 10*b*, and 10*d*, respectively. Consequently, an electrical connection is established between the electric power source and the heat generating members. Then, as the connector terminal 14 is provided with electric power through a lead 21, from the unshown electric power source, both, or one of, the two heat generating member 8*a* and 8*b* generates heat. That is, the fixing device 1 in this embodiment is structured so that the heat generating members 8*a* and 8*b* can be independently driven from each other. Therefore, such a control as adjusting the heat generation amount distribution of the heater 5 according to recording medium sheet size can be carried out.

The heating unit 2 is kept pressed against the pressure roller 3 by an unshown pressure applying means, whereby the film 7 and the pressure roller 3 are kept pressed upon each other. The pressure roller 3 rotates by being driven by an unshown external mechanical power source. The film 7 is rotated by the rotation of the pressure roller 3.

A sheet S of a recording medium bearing an unfixed toner image formed in the unshown image formation station of the image forming apparatus is conveyed to, and then through, the fixation nip 20, which is the area of contact between the heating unit 2 and the pressure roller 3. As the sheet S is conveyed through the fixation nip 20, the toner in the unfixed toner image is fixed (permanently adhered) to the sheet S by the heat and pressure in the fixation nip 20. Thereafter, the sheet S, which is bearing the fixed toner image, is discharged into an unshown delivery area by a pair of sheet conveyance rollers 4.

<Heating Unit>

Next, referring to FIGS. 1-4, the heating unit 2 in this embodiment is described regarding its structure.

First, referring to FIGS. 3(*a*)-3(*c*), the structure of the heater 5 is described. FIG. 3(*a*) is a sectional view of the heater 5. FIG. 3(*b*) is a plan view of the heater 5 as seen from the direction indicated by an arrow mark b in FIG. 3(*a*). It shows the surface of the heater 5, on which the heat generating member 8*a* is present. FIG. 3(*c*) is a plan view of the heater 5 as seen from the direction indicated by an arrow mark c in FIG. 3(*a*). It shows the surface of the heater 5, on which the heat generating member 8*b* is present.

The heater 5 has the dielectric substrate 9 made of ceramic material. It has also the heat generating members 8*a* and 8*b*, which are on the front and rear surfaces, respectively, of the substrate 9. Further, it has electrodes 10*a*-10*d* which the pair of spring contacts 16*a* and 16*b* of the connector terminal 14 contact, as shown in FIG. 7. It has also leads 11 which provide electrical connection between the electrodes 10*a*-10*d* and the pair of heat generating members 8*a* and 8*b*. Further, it has a protective layer 12 for protecting the heat generating members 8*a* and 8*b* and the leads 11. The protective layer 12 is formed of glass or the like substance, and is placed on both of the front and rear surfaces of the substrate 9 to cover the heat generating members 8*a* and 8*b* and the leads 11, except for the electrodes 10*a*-10*d*; the electrodes 10*a*-10*d* are exposed.

The heat generating members 8*a* and 8*b* are made different in dimension in terms of the lengthwise direction (left and right directions in FIGS. 3(*a*) and 3(*b*)), in order to enable the fixing device 1 to accommodate various sheets of a recording medium that are different in size.

Next, referring to FIGS. 4-7, electric power is supplied to the power reception terminal 14*a* of the terminal 14 of the connector 13 through a cable 21 which is connected to the power reception terminal 14*a*. As the electric power is supplied, electric current flows through the heat generating members 8*a* and 8*b* through the pair of spring contacts 16*a* and 16*b* of the terminal 14, electrodes 10*a*-10*d*, and leads 11. Thus, heat is generated in the heat generating members 8*a* and 8*b* (Joule's law).

That is, the heat generating members 8*a* and 8*b* generate heat by the amounts proportional to the supplied amount of electric power. Thus, the amount of heat generated by the heater 5 can be controlled by deciding whether both or only one of the two heat generating members 8*a* and 8*b* is to be supplied with electric power.

<Attachment of Connector>

Figure 2:
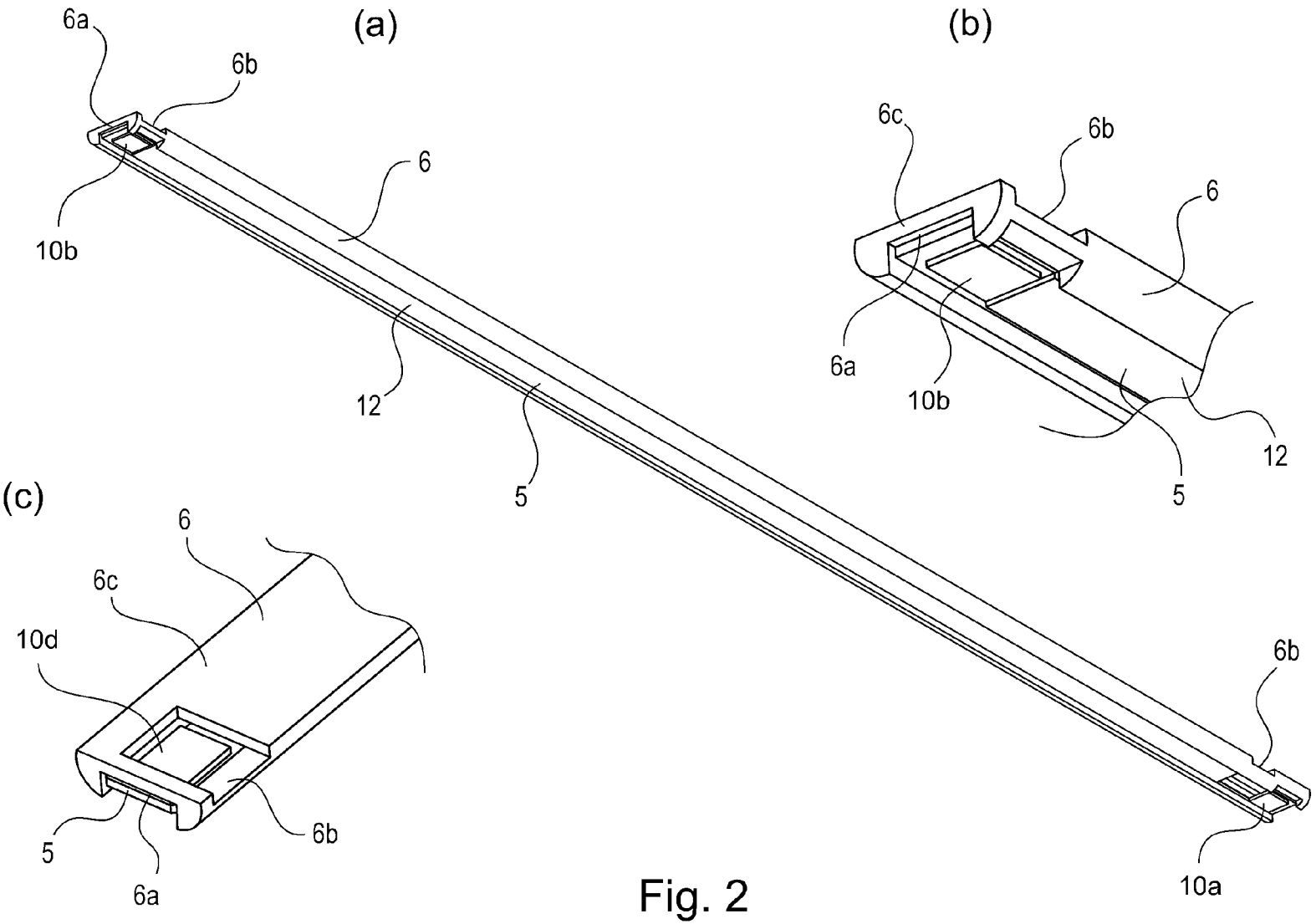
FIGS. 2(*a*), 2(*b*), and 2(*c*) are perspective views of the heater and heater supporting member, and shows how the heater is supported by the heater supporting member.

Next, referring to FIGS. 2(*a*), 2(*b*), 2(*c*) and 4, how the connector 13 is attached to the heating unit 2 is described. FIG. 2 shows how the heater 5 is supported by the heater supporting member 6 (heater holder). FIG. 2(*b*) shows the overall structure of the combination of the heater 5 and the heater supporting member 6. FIG. 2(*b*) is a perspective view of one of the lengthwise end portions of the combination, as seen from the side on which the heater 5 contacts the film 7. FIG. 2(*c*) is a perspective view of the same portion of the combination, as seen from the opposite side from the side on which the heater 5 contacts the film 7.

The heater supporting member 6 is provided with a groove 6*a* which extends in the lengthwise direction (left and right directions in FIG. 2(*a*)) of the heater supporting member 6, and in which the heater 5 is held. It supports the cylindrical film 7 (shown in FIG. 1), in such a manner that the film 7 can be circularly moved while sliding on the film supporting surface of the heater supporting member 6. In other words, the heater supporting member 6 controls the position of the film 7 in the fixation nip 20.

Figure 4:
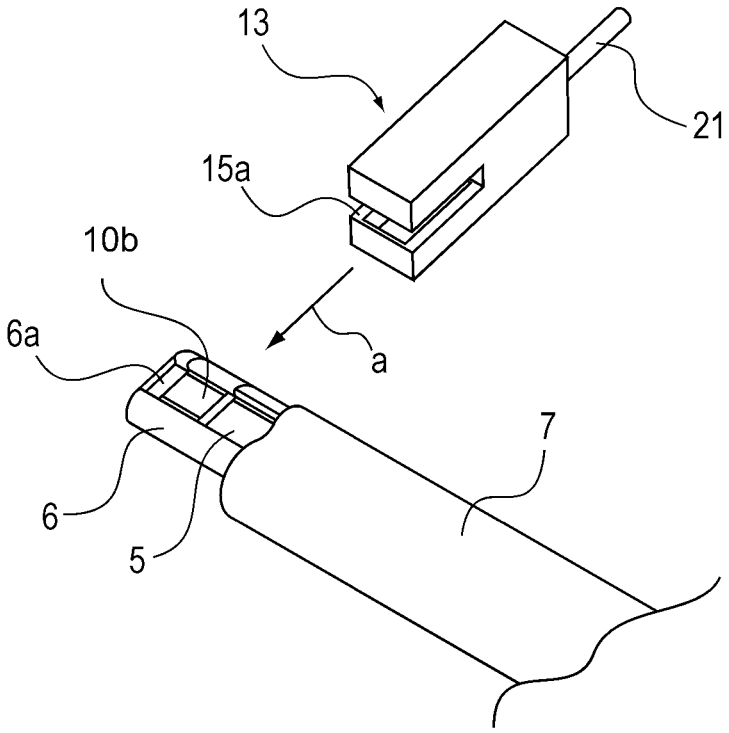
FIG. 4 is a schematic perspective view of the combination of the heater, heater supporting member, and endless film. It shows how the connector is attached to the combination.

Referring to FIGS. 2(*a*)-2(*c*), the heater supporting member 6 has a slot 6*b*, through which the electrodes 10*a* and 10*c* are exposed. FIG. 4 shows how the connector 13 is to be connected to the heater 5. The connector 13 is attached to the heater supporting member 6 by being moved to one of the lengthwise end portions of the heater supporting member 6, which is on the outward side of the film 7 in terms of the widthwise direction of the film 7, in the direction indicated by an arrow mark a in FIG. 4.

<Structure of Connector>

Figure 5:
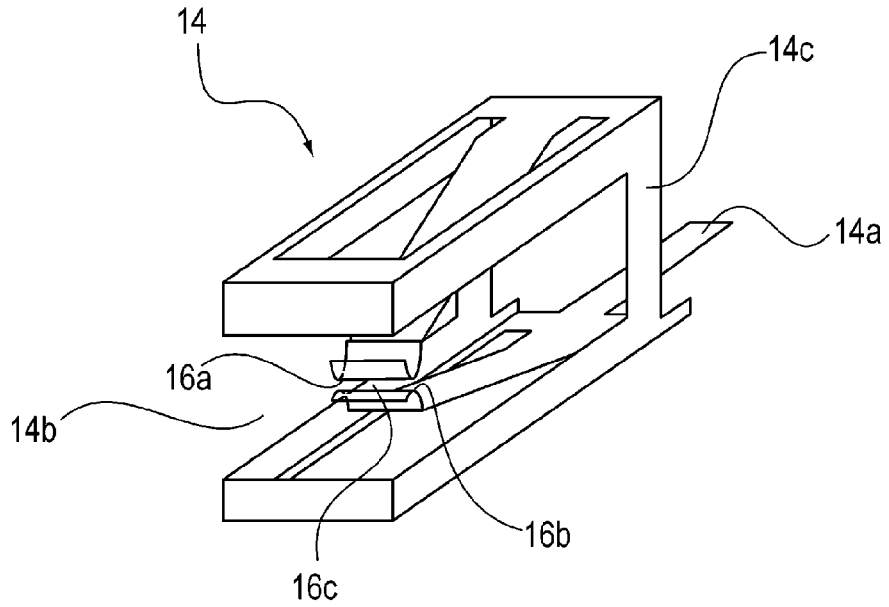
FIG. 5 is a perspective view of the terminal of the connector in the first embodiment, and shows the structure of the terminal.
Figure 6:
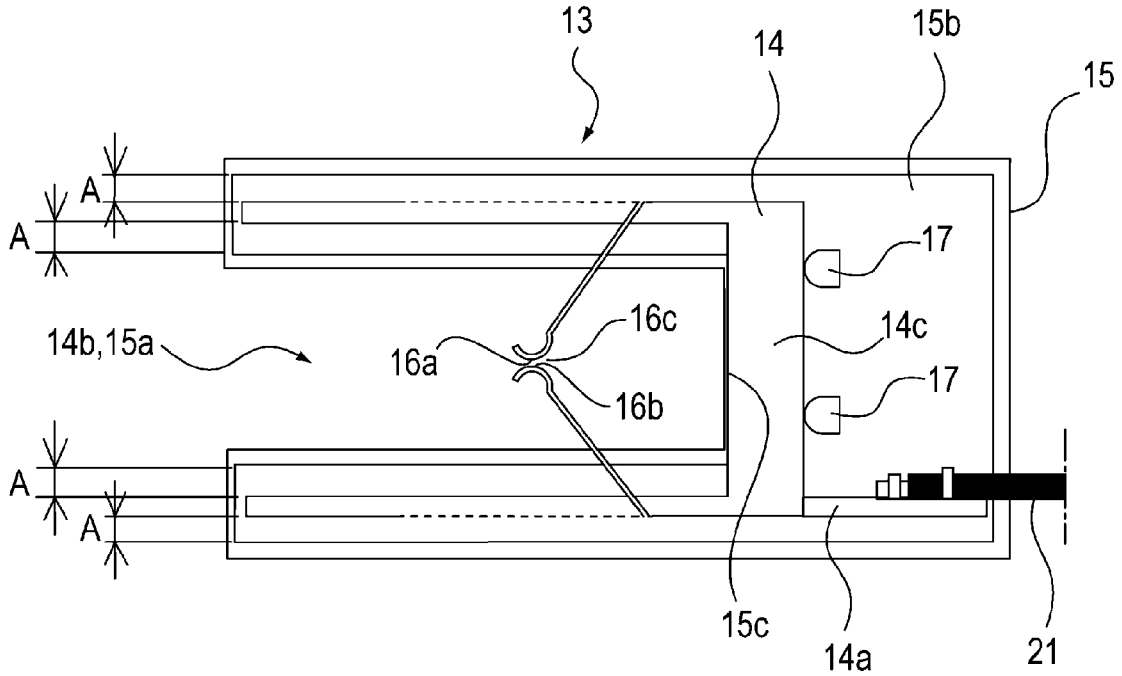
FIG. 6 is a sectional view of the connector, and shows the structure of the connector.
Figure 7:
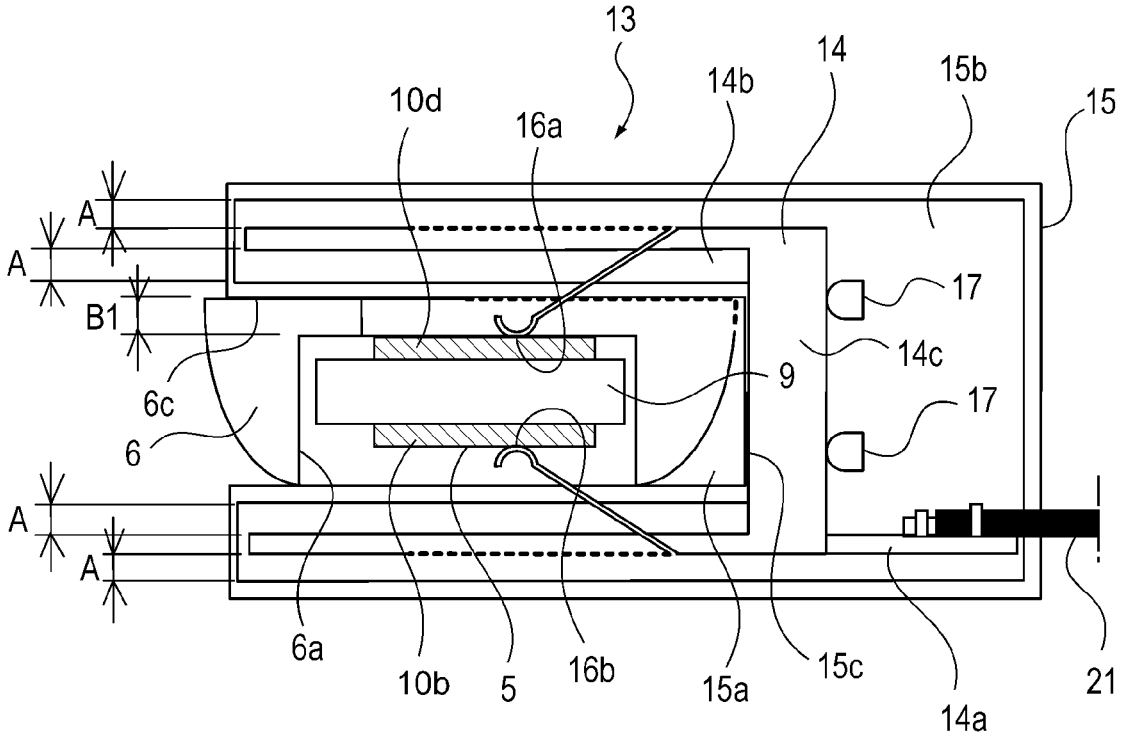
FIG. 7 is a sectional view of the combination of the connector, heater, and heater supporting member, when the connector is in engagement with the heater and heater supporting member.

Next, referring to FIGS. 5 and 6, the structure of the connector 13 is described. FIG. 5 is a perspective view of the terminal 14 of the connector 13. It shows the structure of the terminal 14. FIG. 6 is a sectional view of the connector 13 made up of the housing 15 and the terminal 14 inserted in the housing 15 in such a manner that it is allowed to move in the direction perpendicular to the front and rear surfaces of the heater 5 (vertical direction in FIG. 6). It also shows the structure of the connector 13.

Referring to FIG. 6, the connector 13 is made up of the housing 15, which is roughly U-shaped in cross section, as seen from the direction perpendicular to the direction in which the connector 13 is attached to the heater 5 (heater supporting member 6), and the terminal 14, which also is roughly U-shaped in cross section. More specifically, the lateral walls of the housing 15, and the lateral walls of the terminal 14, in terms of the direction in which the connector 13 is attached to the heater supporting member 6, are provided with a slot of a preset size. The terminal 14 is positioned in the housing 15 in such a manner that it is allowed to move within the housing 15. The terminal 14 is made of an electrically conductive substance, such as stainless steel or titanium alloy, and is plated. The housing 15 is made of dielectric substance such as resin.

The connector terminal 14 is provided with the pair of spring contacts 16*a* and 16*b*, which press on the pair of electrodes on the front and rear surfaces, one for one, of the heater 5, so that a preset amount of contact pressure is generated, and maintained, between the spring contacts 16*a* and 16*b* and the corresponding electrodes of the heater 5. The two spring contacts 16*a* and 16*b* are the same in shape, and are symmetrically positioned with reference to a plane parallel to the front and rear surfaces of the housing 15 and coincides with the center of the housing 15 in terms of the direction perpendicular to the front and rear surfaces of the housing 15. Referring again to FIG. 6, the connector 13 (terminal 14) is structured so that when the electrode portion of the heater 5 is not in the space of the connector terminal 14, which corresponds in position to the aforementioned slot of the lateral wall of the terminal 14, there is a preset amount of gap 16*c* between the pair of spring contacts 16*a* and 16*b* of the connector terminal 14.

The housing 15 of the connector 13 is structured so that there is a space 15*b*, which is U-shaped in cross section and allows the connector terminal 14 to perpendicularly (vertical direction in FIG. 6) move relative to the front and rear surfaces of the housing 15.

The connector terminal 14 is fitted into the housing 15 by being inserted into the housing 15 from an unshown opening of the housing 15, which is on the opposite side (right side in FIG. 6) of the housing 15 from the space 15*b*. The inward surface of the housing 15 is provided with a pair of projections 17 for preventing the connector terminal 14 from becoming disengaged from the housing 15. Thus, as the connector terminal 14 is inserted into the housing 15 to a preset position, the vertical portion 14*c* (in FIG. 6) of the connector terminal 14 engages with the projections 17, preventing thereby the terminal 14 from coming out of the housing 15. The projections 17 also play a role of controlling the connector terminal 14 in position relative to the housing 15 after the connector 13 is properly attached to the heater supporting member 6.

Referring to FIG. 6, the housing 15 and the terminal 14 of the connector 13 are structured so that after the insertion of the terminal 14 into the housing 15, there are clearances A between the top portion of the housing 15 and top portion of the connector terminal 14, and also, between the bottom portion of the housing 15 and bottom portion of the connector terminal 14, in terms of the direction (vertical direction in FIG. 6) perpendicular to the front and rear surfaces of the heater 5. In this embodiment, the inward surface of the housing 15 has two projections 17, which are different in position. Thus, the terminal 14 is retained in the housing 15 in such a manner that the vertical portion 14*c* of the terminal 14 is regulated in position, in terms of the direction in which the connector 13 is moved to be engaged with the heater supporting member 6, by the bottom wall 15*c* of the recess 15*a* (vertical portion of edge of recess 15*a* in FIG. 6), and the projections 17, while being allowed to move in the vertical direction in FIGS. 6-8.

Figure 8:
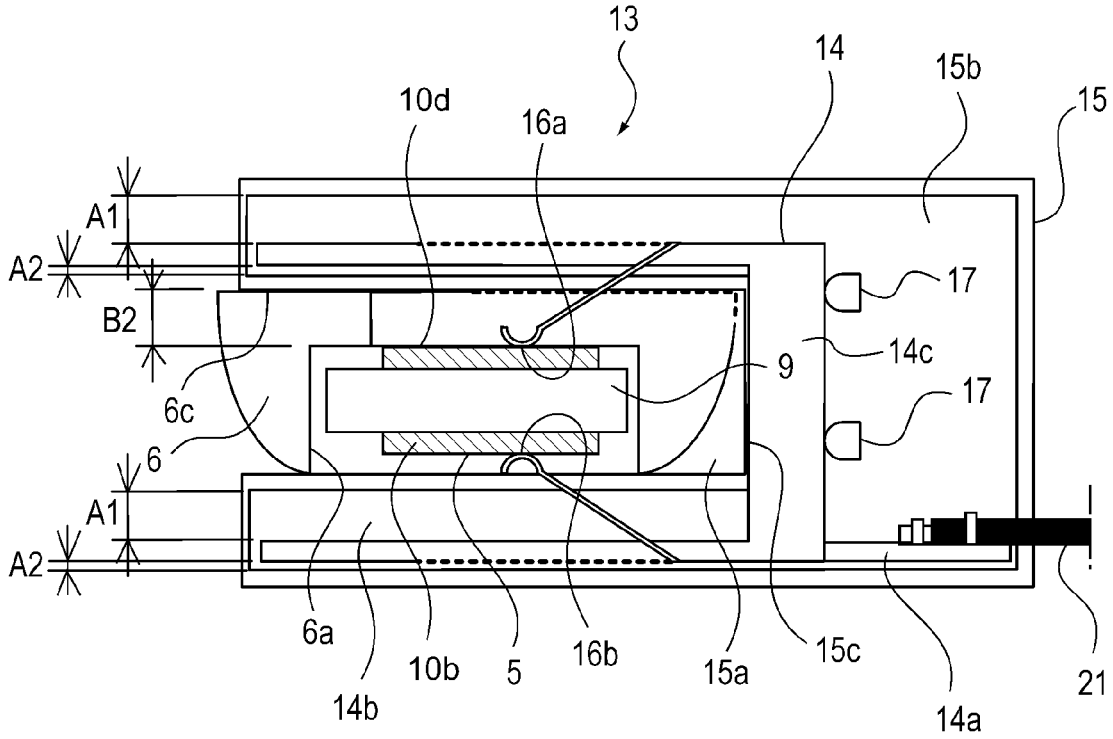
FIG. 8 is a sectional view of the combination of the connector, heater, and heater supporting member (which is different in thickness from the one in FIG. 7) when the connector is in engagement with the heater and heater supporting member.

The connector 13 and its terminal 14 are structured so that as the terminal 14 is inserted into the housing 15 of the connector 13, the spring contacts 16*a* and 16*b* oppose each other in the vertical direction in FIGS. 6-8. Further, they are structured so that when the connector 13 is not in engagement with the heater 5, a preset amount of gap 16*c* is provided between the spring contacts 16*a* and 16*b*, as shown in FIG. 6, in order to prevent the surface plating of the spring contacts 16*a* and 16*b* from being peeled away.

FIGS. 7 and 8 are sectional views of the connector 13 when the connector 13 is in connection to the heater 5. They are different in the thickness of the heater seat portion of the heater supporting member 6, which is attributable to the dimensional tolerance for the heater supporting member 6 (thickness in FIG. 7 is B1, whereas thickness in FIG. 8 is B2).

As the connector 13 is connected to the heater 5, the housing 15 of the connector 13 sandwiches the heater supporting member 6, whereas the pair of spring contacts 16*a* and 16*b* of the connector terminal 14 come into contact with the electrodes 10*d* and 10*b*, respectively, of the heater 5, in the housing 15, so that the heat generating members 8*a* and 8*b* can be supplied with electric power.

That is, as the connector 13 engages with the heater supporting member 6 on which the heater 5 is held, the housing 15 engages with the heater supporting member 6. The spring contacts 16*a* and 16*b* come into contact with the electrodes 10*d* and 10*b* on the front and rear surfaces, one for one, of the heater 5, in such a manner that a preset amount of contact pressure is generated and maintained between the spring contacts 16*a* and 16*b*, and the electrodes 10*d* and 10*c*, respectively.

Next, referring to FIG. 8, it is assumed here that because of the dimensional tolerance for the components of the heating unit 2 and the connectors 13, the components are not perfectly accurate in dimension. For example, it is assumed that because of the errors in the dimension of the abovementioned components, the gap B2, between the bottom surface of the groove 6*a*, and the actual heater supporting portion 6*c* of the heater supporting member 6, shown in FIG. 8, is larger than the gap B1 between the bottom surface of the groove 6*a*, and the actual heater supporting portion 6*c* of the heater supporting member 6, shown in FIG. 7.

In such a case, the position of the heater 5 relative to the housing 15 in terms of the vertical direction in FIG. 8 is different from that in FIG. 7. If the heater position relative to the housing 15 of the connector 13 is different from the position in the specification, the contact pressure between the heater electrode and the spring contact becomes different from that in the specification. In this embodiment, however, the connector 13 is structured so that its terminal 14 is allowed to freely move in the vertical direction in FIG. 8, within the internal space of the housing 15, and also, that the pair of spring contacts 16*a* and 16*b* of the connector terminal 14 are the same in shape and are symmetrically positioned relative to each other.

Therefore, the connector terminal 14 moves in the vertical direction in FIG. 8 according to the vertical dimension of the heater 5 in FIG. 8. In FIG. 7, the clearance between the housing 15 and terminal 14 is A, which is in a range of 0.3 mm-1.5 mm (0.3 mm ≤A≤1.5 mm), whereas in FIG. 8, the clearances between the housing 15 and terminal 14 are A1 or A2, indicating that the connector terminal 14 has moved. Therefore, the contact pressure between the pair of spring contacts 16*a* and 16*b*, and the electrodes 10*b* and 10*d*, respectively, in FIG. 8 remains roughly the same as that in FIG. 7, despite the deviation in the component dimension. Therefore, the heater 5 is not subjected to an excessive amount of stress. In other words, this embodiment ensures that as the connector 13 is engaged with the heater supporting member 6, the spring contacts 16*a* and 16*b* come into, and remain in, contact with the electrodes 10*d* and 10*b*, in such a manner that a preset amount (proper amount) of contact pressure is generated and maintained between the spring contacts of the terminal 14 and the electrodes of the heater 5, one for one, without requiring that the components of the heater 5, the heater supporting member 6, and the connector 13 are highly accurate in measurement.

Next, the connector in the second embodiment, and the connector in the third embodiment, are described. The only difference in the second and third embodiments from the first embodiment is in the shape of the connectors. Therefore, the second and third embodiments are described regarding the difference of their connectors from the connector 13 in the first embodiment. In the following description of the second and third embodiment, the heater, the heater holder, and the electrodes (on both surfaces of heater substrate, one for one), are referred to as heater 100, the heater holder 106, and the electrodes 103*d* and 103*e*.

[Embodiment 2]

Figure 10:
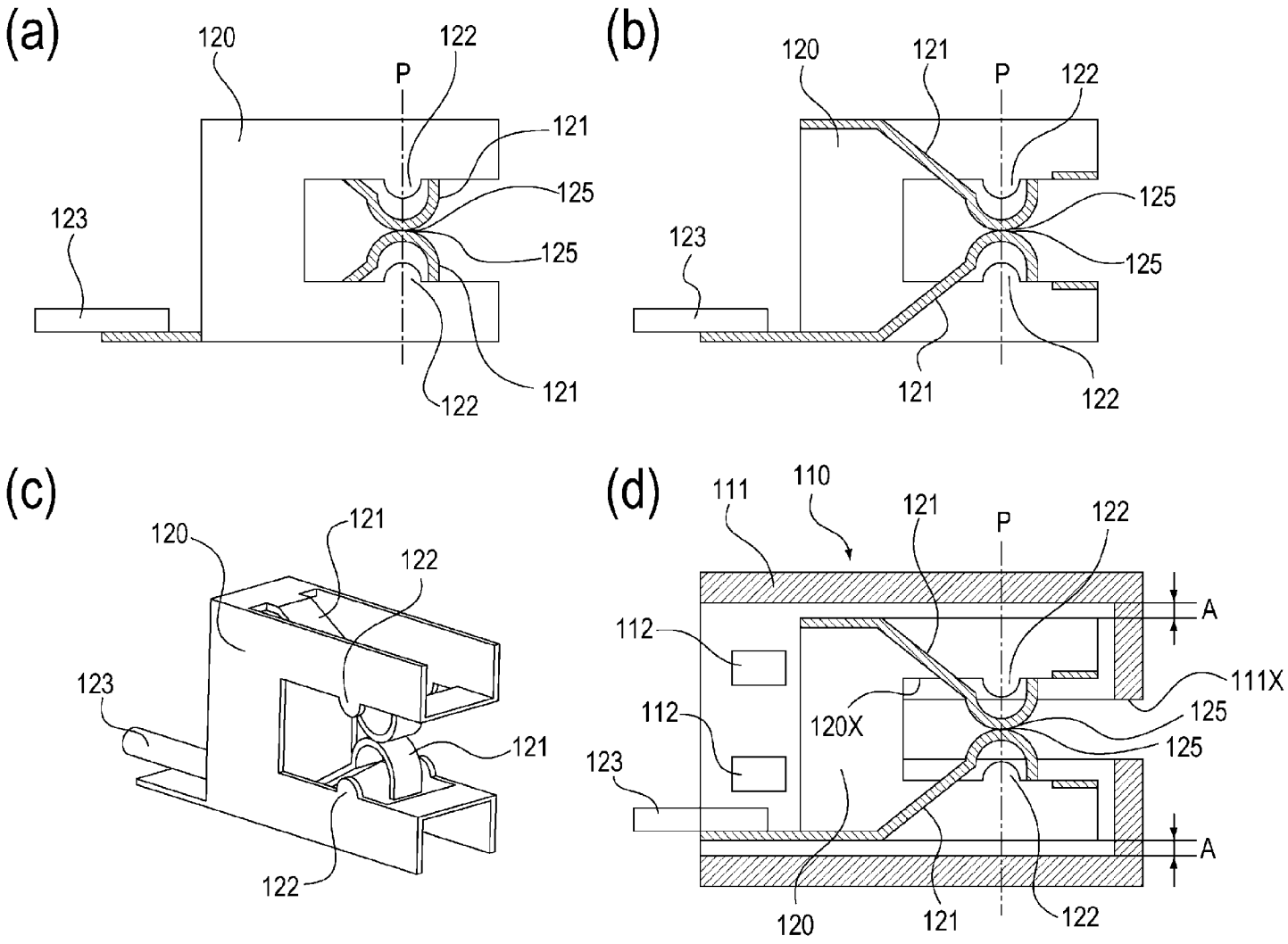
FIGS. 10(*a*)-10(*d*) are schematic drawings of the connector in the second embodiment of the present invention, and shows the structure of the connector.

FIG. 10(*a*) is a side view of the terminal 120 of the connector 110, and shows the structure of the terminal 120. FIG. 10(*b*) is a sectional view of the connector terminal 120. FIG. 10(*c*) is a perspective view of the connector terminal 120, and shows the structure of the terminal 120. FIG. 10(*d*) is a sectional view of the connector 110, and shows the structure of the connector 110. Referring to FIG. 10(*d*), the connector 110 is provided with a housing 111, and a terminal 120 having a pair of spring contacts 121 and a pair of protrusions 122.

Referring to FIGS. 10(*a*)-10(*d*), the housing 111 is structured so that it appears roughly U-shaped in cross section. It has an opening 111X, which may be referred to as the "first opening", hereafter. The connector terminal 120 also is structured so that it appears roughly U-shaped in cross section; it has a pair of roughly U-shaped lateral walls having a slot 120X which may be referred to as the "second opening", hereafter. The connector 110 is structured so that the connector terminal 120 is allowed to change in attitude even after the insertion of the connector terminal 120 into the housing 111. Further, the connector terminal 120 is provided with a pair of spring contacts 121, and a pair of protrusions 122. Further, the connector 110 and its terminal 120 are structured so that when the connector terminal 120 is properly situated in the housing 111, the openings 120X and 111X are in alignment with each other in terms of the direction in which the connector terminal 120 is inserted into the housing 111.

The pair of spring contacts 121 extend toward each other from the top and bottom sides of the slot 120X. That is, the first spring contact 121 (top spring contact in FIG. 11), which is one of the pair of spring contacts 121, extends diagonally downward from the top side of the slot 120X, whereas the second spring contact (bottom spring contact in FIG. 11), which is the other of the pair of spring contacts 121, extends diagonally upward from the bottom side of the slot 120X. The pair of spring contacts 121 are springy. Thus, as the spring contacts 121 are subjected to a load, they resiliently bend. The point 125 of contact of one of the spring contacts 121, and the point 125 of contact of the other of the spring contacts 121, come into contact with the electrodes 103*e* and 103*d*, respectively, of the heater 100. The portion of each spring contact 121, by which the spring contact 121 contacts the corresponding electrode 103, is shaped so that it appears semicircular in cross section. This semicircularly curved portion of the spring contact 121*c* serves as the actual point 125 of contact.

The pair of protrusions 122 protrude toward each other from the top and bottom edges of each slot 120X of the connector terminal 120, so that each protrusion 122 coincides in position with the point 125 of contact of the corresponding spring contact 121. More specifically, the first protrusion 122 (bottom protrusion in FIGS. 11(*a*) and 11(*b*)), which is one of the pair of protrusions 122, coincides in position with the point 125 of contact of the first spring contact 121. It is shaped so that it protrudes upward from the bottom edge of the slot 120X, whereas the second protrusion 122 (top protrusion in FIGS. 11(*a*) and 11(*b*)) coincides in position with the point 125 of contact of the second spring contact 121, and is shaped so that it protrudes downward from the top edge of the slot 120X. Unlike the spring contacts 121, the protrusions 122 are not elastic. Further, each protrusion 122 is shaped so that its area of contact is semicircular in cross section. As described above, the bottom protrusion 122 (top protrusion 122) which supports (backs up) the object (heater) to be supported (backed up), is on the bottom edge of the slot 120X of each of the lateral walls of the connector terminal 120. It coincides in position with the point 125 of contact of the top (bottom) spring contact 121.

The connector terminal 120 is roughly U-shaped in cross section. It is made of stainless steel, titanium alloy, or the like substance, and is plated. It is provided with the pair of spring contacts 121, which are on the top and bottom sides, one for one, of the slot 120X. Each spring contact 121 has the point 125 of contact, which is the actual portion of the spring contact 121, by which the spring contact 121 presses upon one of the electrodes of the heater 100. The connector terminal 120 is provided with four protrusions 122 (which contact heater 100), which coincide with a vertical plane P (in FIG.

10) which coincides with the point 125 of contact of the top spring contact 121 and the point 125 of contact of the bottom spring contact 121. Therefore, the distance from the entrance of the slot 120X (right end in FIG. 10(*a*)) to the top protrusion 122 (top protrusion 122) is roughly the same as the distance from the entrance of the slot 120X to the point 125 of contact of the top spring contact 121 (point 125 of contact of bottom spring contact 121).

Further, the end portion of the connector terminal 120, which is on the opposite side of the connector terminal 120 from the slot 120X, is connected to a bundle 123 of fine wires, so that voltage can be applied to the connector terminal 120 through the bundle 123 of fine wires. As described above, the connector 110 is made up of the housing 111, and the connector terminal 120 fitted in the housing 111. The housing 111 is roughly U-shaped in cross section like the lateral walls of the connector terminal 120 of the connector 110. The housing 111 is provided with a pair of retainers 112, which prevent the connector terminal 120 from coming out of the housing 111 after the insertion of the terminal 120 into the housing 111 from the opposite side of the housing 111 from the opening 111X of the housing 111. Further, the connector 110 is structured so that after the proper insertion of the connector terminal 120 into the housing 111, there is a clearance A between the connector terminal 120 and housing 111.

Figure 11:
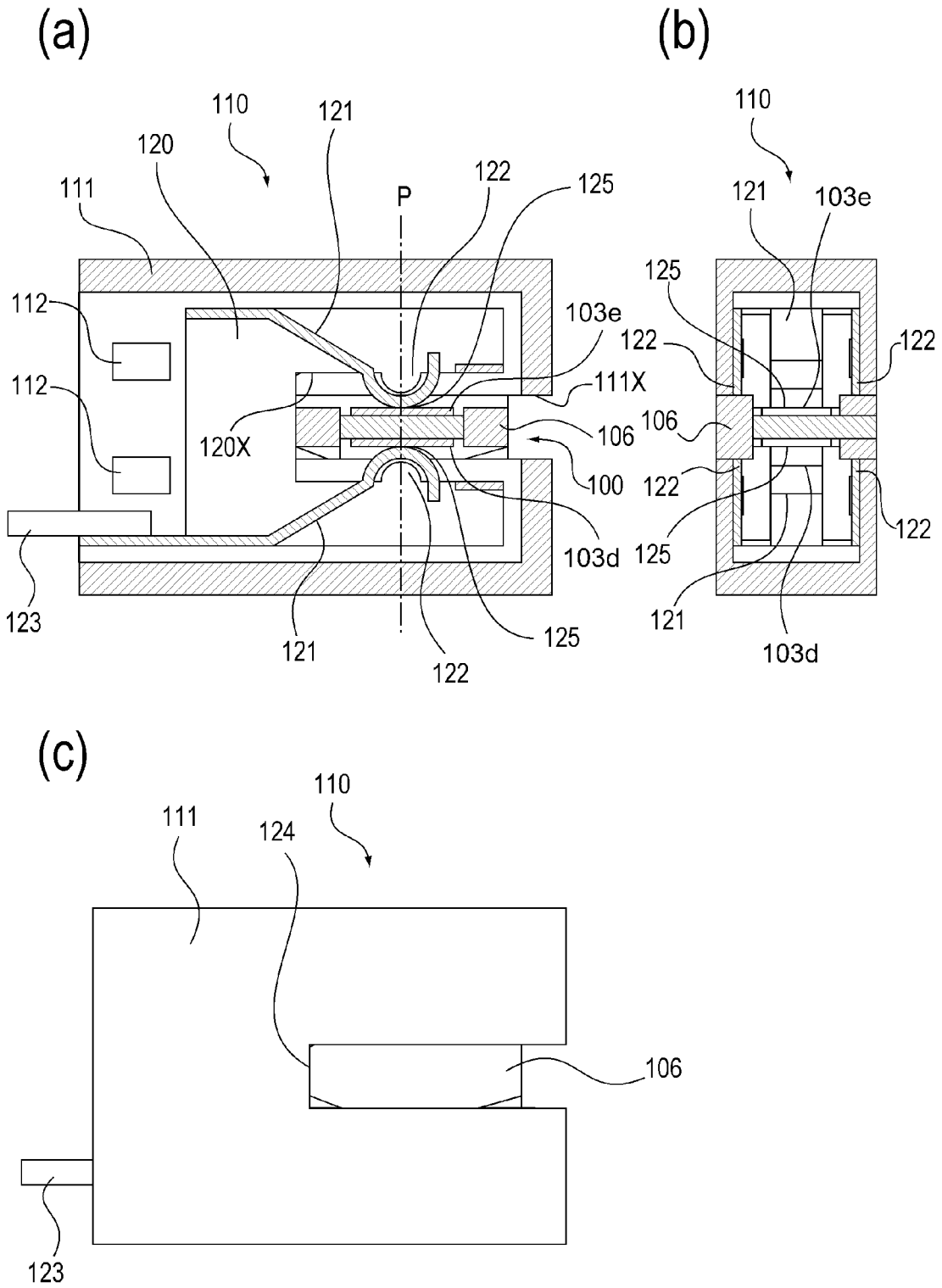
FIGS. 11(*a*)-11(*c*) are drawings of the combination of the connector (shown in FIGS. 10(*a*)-10(*d*)), heater, and supporting member, when the connector is in engagement with the heater and heater supporting member.

FIG. 11(*a*) is a sectional view of the combination of the connector 110 and heater 100 after the connection of the connector 110 to the heater 100. FIG. 11(*b*) is a sectional view of the combination of the connector 110 and heater 100, at the plane P-P in FIG. 11(*a*), after the connection of the connector 110 to the heater 100. FIG. 11(*c*) is a side view of the connector 110 after its engagement with the heater supporting member 106. It shows the structure of the connector 110. Referring to FIG. 11(*a*), when the connector 110 is connected to the heater 100, the supporting member 106, which supports the heater 100, is in contact with the edges of the slot 120X of the connector terminal 120.

As the connector 110 is engaged with the supporting member 106, which is supporting the heater 100, the supporting member 106 comes into contact with the vertical edge 124 (in FIG. 11(*c*)) of the slot 120X of the terminal 120 of the connector 110. Further, the point 125 of contact of the top spring contact 121, and the point 125 of contact of the bottom spring contact 121 come into contact with the top and bottom electrodes 103*e* and 103*d* of the heater 100, generating a preset amount of contact pressure between themselves and the corresponding electrodes 103*e* and 103*d*, respectively. Further, the top and bottom protrusions 122 of the connector terminal 120 come into contact with the heater supporting member 106, at the plane P which coincides in position with the top and bottom points 125 of contact.

More specifically, as the connector 110 is engaged with the supporting member 106 on which the heater 100 is present, each protrusion 122 comes into contact with the supporting member 106 at the same time as the corresponding point 125 of contact of the spring contact 121 comes into contact with the electrode of the heater 100.

In this case, the first spring contact 121 presses on the first electrode 103*e* from the top side of the heater 100, and the first protrusion 122 comes into contact with the supporting member 106 from the bottom side of the supporting member 106. Further, the second spring contact 121 presses on the second electrode 103*d* from the bottom side of the second electrode 103*d*, and the second protrusion 122 comes into contact with the supporting member 106 from the top side of the supporting member 106. Consequently, the supporting member 106 is sandwiched by the first and section protrusions 122.

Figure 12:
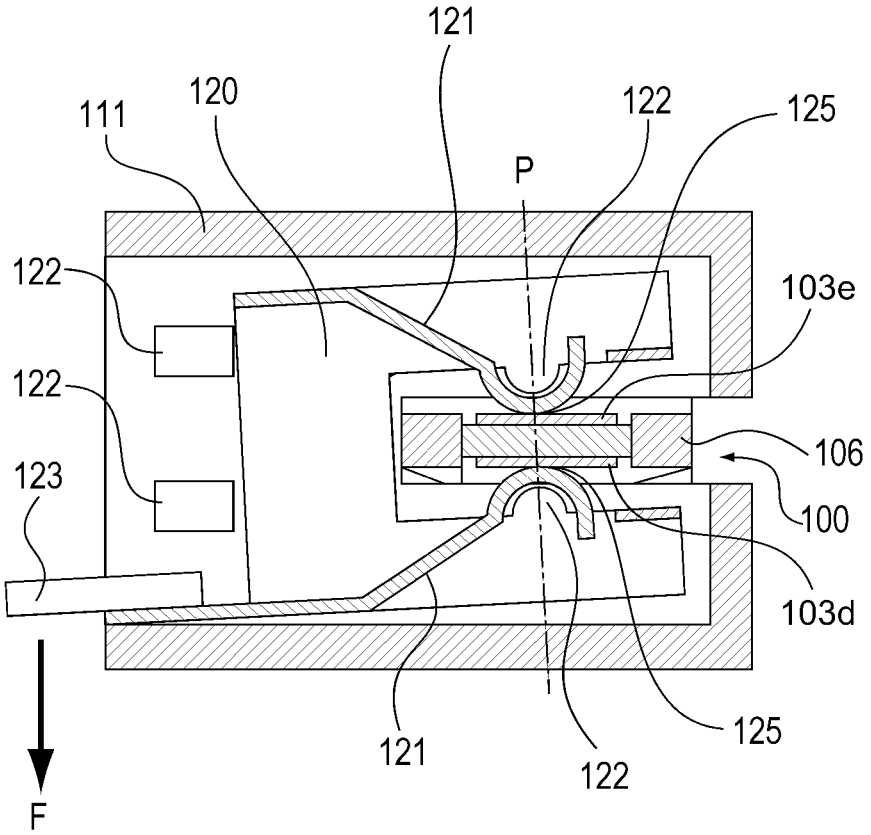
FIG. 12 is a sectional view of the combination of the connector (shown in FIG. 10), heater, and supporting member, when the connector terminal is tilted relative to the connector housing while being in engagement with the heater and heater supporting member.

FIG. 12 is a sectional view of the combination of the connector 110 and the heater 100 after the connector terminal 120 has tilted in the housing 111. As is evident from FIG. 12, in a case where the connector terminal 120 is subjected to an external force F (downward force in FIG. 12), such as the reactive force which is generated as the bundle 123 of fine wires attached to the aforementioned end of the connector terminal 120 is moved, the connector terminal 120 is allowed to pivotally move about the point of contact of the protrusion 122 in an oscillatory manner, within the housing 111. However, the point of contact between the connector terminal 120 and the supporting member 106, on which the heater 100 is held, coincides with the plane P which coincides with the point 125 of contact of the spring contact 121. Therefore, the connector terminal 120 is allowed to pivotally move about the adjacencies of the point 125 of contact, without being twisted and/or bent.

Therefore, there is virtually no change in the position of the point 125 of contact of the spring contact 121. Therefore, there occurs no change in the amount of the contact pressure between the point 125 of contact of the spring contact 121 and the corresponding electrode of the heater 100. Therefore, it does not occur that as the connector terminal 120 becomes tilted, the point 125 of contact of the spring contact 121 becomes separated from the electrode of the heater 100. Incidentally, even if the connector 110 is structured so that the protrusion 122 directly contacts the heater 100, instead of the supporting member 106, in the plane P which coincides with the point 125 of contact, the effect of the present invention is the same as the above described one.

[Embodiment 3]

Figure 13:
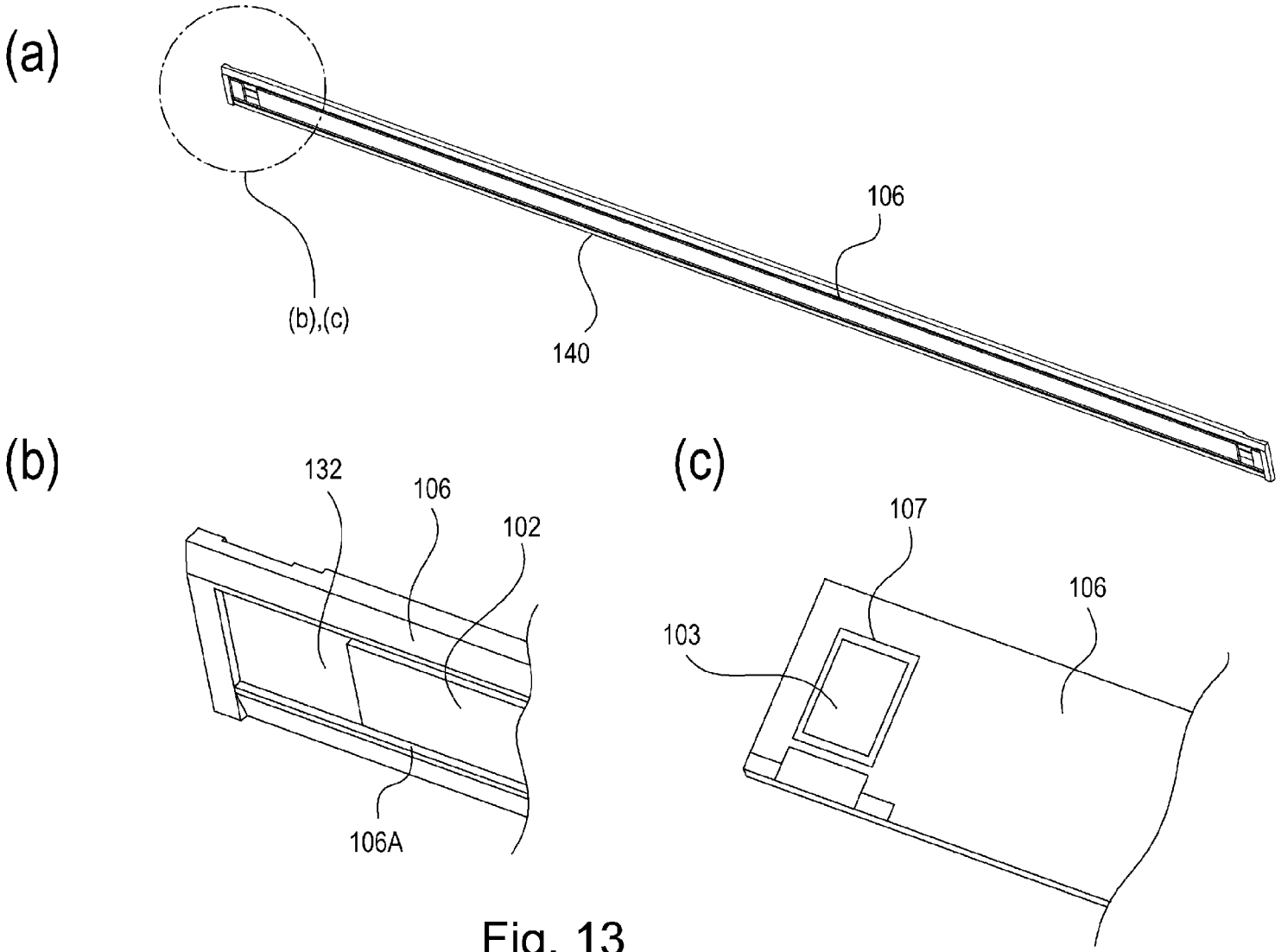
FIGS. 13(*a*)-13(*c*) are drawings of the combination of the heater and the heater supporting member in the third embodiment of the present invention, and show the structure of the combination.

FIG. 13(*a*) is a perspective view of the combination of the heater 140 to which the connector 210 is attached, and the supporting member 106 for supporting the heater 140, in the third embodiment. It shows the structure of the combination. FIG. 13(*b*) is a perspective view of one of the lengthwise end portions of the combination of the heater 140 and the supporting member 106, as seen from the side on which the supporting member 106 contacts the film 33. It shows the structure of the lengthwise end. FIG. 13(*c*) is a perspective view of one of the lengthwise end portions of the supporting member 106, as seen from the side on which the supporting member 106 is supported. It shows the structure of the lengthwise end portion. The components of the connector 210, heater 140, and the heater supporting member 106, which are the same in structure and effect as the counterparts in the second embodiment, are given the same reference numerals and characters as those given to their counterparts in the second embodiment, and are not described here. The difference between the third embodiment and second embodiment of the present invention, in terms of the structure of the connector, heater, and the heater supporting member, is as follows.

The connector in the second embodiment is for a two-sided heater, that is, a heater having a heat generating member on both the top and bottom surface of its substrate. In comparison, the connector in this embodiment is for a one-sided heater 140, that is, a heater having a heat generating member 102 and an electrode 103 for the heat generating member 102, on only one of the top and bottom surfaces of its substrate. First, how the one-sided heater 140 is supported by the supporting member 106 is described with reference to FIGS. 13(*a*)-13(*c*).

Referring to FIG. 13(*a*), the supporting member 106 supports the one-sided heater 140. Next, referring to FIG. 13(*b*), the supporting member 106 is provided with a groove 106A, which extends in the lengthwise direction of the supporting member 106. The one-sided heater 140 is held in this groove 106A. The supporting member 106 regulates the belt 33, which in this embodiment is in the form of a film, in position as the film 33 is circularly moved. The supporting member 106 is provided with a spacer 132, which is placed on the same surface of the supporting member 106 as the one which the heat generating member 106 is placed. Referring to FIG. 13(*c*), the supporting member 106 is provided with a hole 107, through which the electrode 103 is exposed. However, the heating unit may be structured so that both the heat generating member 102 and the electrode 103 are on one of the primary surfaces of the supporting member 106, and the spacer 132 is on the other primary surface, that is, the opposite surface from the surface on which the heat generating member 102 and electrode 103 are placed.

Figure 14:
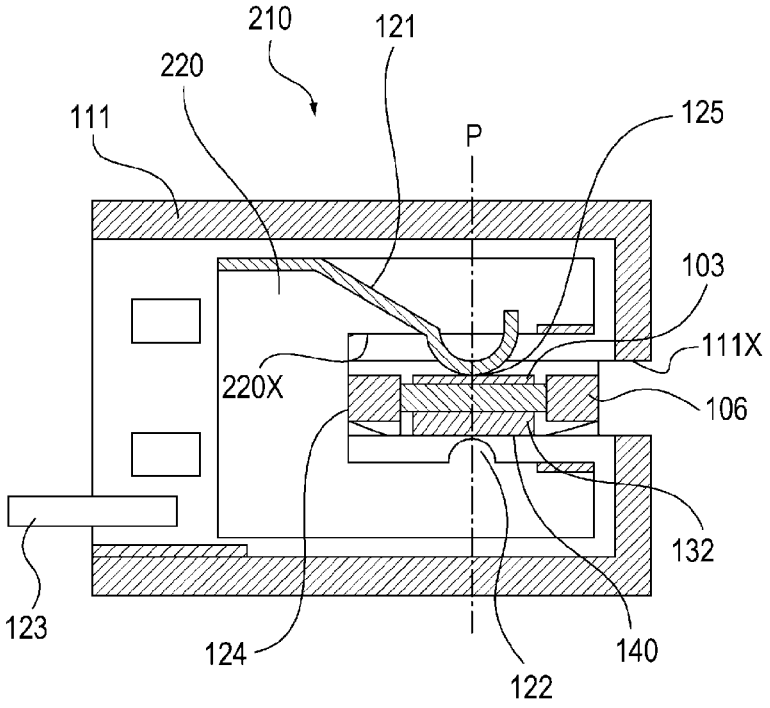
FIGS. 14(*a*) and 14(*b*) are sectional views of the combination of the connector, the heater, and the heater supporting member in the third embodiment the present invention, when the connector is in engagement with the heater and the heater supporting member.
Figure 14:
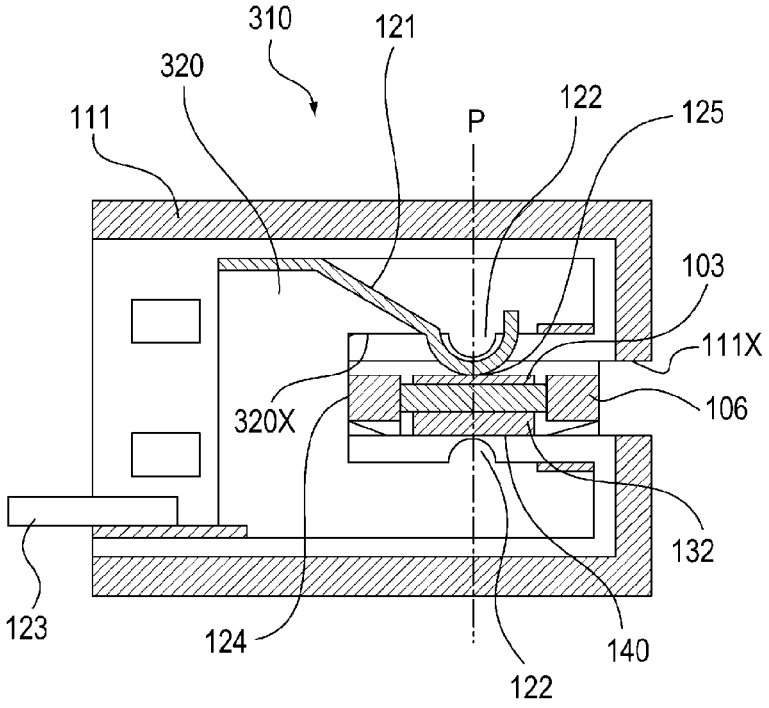

FIG. 14(*a*) is a sectional view of the combination of the connector 210 and the one-sided heater 140 after the engagement of the connector 210 with the heater 140.

The spring contact 121 extends diagonally downward from the top side of the slot 220X. To describe this structure in detail, the base portion of the spring contact 121 is a part of the top wall of the connector terminal 220, and extends diagonally downward into the space of the terminal 220, which corresponds in position to the slot 220X so that the point 125 of contact of the terminal 220 coincides in position with the slot 220X. Thus, as the connector 210 is attached to the heating unit, the point 125 of contact of the spring contact 121 comes into contact with the electrode 103 of the one-sided heater 140.

One of the protrusions 122 protrudes upward from the bottom edge of the slot 220X, toward the point 125 of contact of the spring contact 121. Thus, as the connector 210 is engaged with the heating unit, the protrusion 122 comes into contact with the spacer 132 attached to the supporting member 106, and the spring contact 121 comes into contact, from above, with the electrode 103 exposed through the hole 107, and presses on the electrode 103 so that a preset amount of contact pressure is generated and maintained between the point 125 of the spring contact 121 and the electrode 103.

Since the connector 210 and the heating unit in this embodiment are structured as described above, the contact pressure between the point 125 of contact (which opposes bottom protrusion 122) and the electrode 103 of the heater 140 does not decrease from the initial amount (preset amount), even if the connector 120 is subjected to an external force. Further, even if the terminal 220 is moved by an external force in the opposite direction, all that happens is that the connector terminal 120 pivotally moves about the adjacencies of the protrusion 122 in an oscillatory manner. Therefore, the contact pressure between the point 125 of contact and the electrode 103 does not change.

FIG. 14(*b*) is a sectional view of one of the modified versions of the connector 210 in the third embodiment of the present invention. Referring to FIG. 14(*b*), the connector terminal 320, or the modified version of the terminal 220 of the connector 210 in the third embodiment, is structured so that it appears roughly U-shaped in cross section. It has a pair of protrusions 122 which protrude from the top and bottom edges of the slot 320X, one for one, and which contact the supporting member 106 from the top and bottom sides, respectively.

To describe this structure in detail, the connector terminal 320 is provided with not only the protrusion 122, which protrudes upward from the bottom edge of the slot 320X, but also is provided with the protrusion 122, which protrudes downward from the top edge of the slot 320X. The connector terminal 320 is structured so that the two protrusions 122 squarely oppose each other. Further, the connector terminal 320 is provided with a spring contact 121 having a point 125 of contact. The point 125 of contact comes into contact with the electrode 103 of the one-sided heater 140 in such a manner that a preset amount of contact pressure is generated and maintained between itself and the electrode 103, as the connector 310 is engaged with the heater 140. The position of the point 125 of contact coincides with the plane P, which coincides in position with the top and bottom protrusions 122. Thus, as the connector 310 is engaged with the heater 140, the supporting member 106 by which the one-sided heater 140 is supported comes into contact with the bottom edge 124 of the slot 320X, and the point 125 of contact of the spring contact 121 comes into contact with the electrode 103, generating a preset amount of contact pressure between itself and the electrode 103. Further, the protrusions 122 come into contact with the supporting member 106.

Since the modified version 310 of the connector terminal 320 in the third embodiment is structured as described above, if the connector terminal 320 is subjected to an external force such as the reactive force which occurs as the bundle 123 of fine wires attached to the connector terminal 320 is moved, all that occurs is that the connector terminal 320 pivotally moves about the adjacencies of the protrusions 122, within the housing 111. Therefore, the contact pressure between the point 125 of contact (which coincides with plane P which coincide with the protrusion 122) and the electrode 103 does not change.

The combinations of connector, the heater, and the supporting member in the first and second embodiment, and the modified version of the combination in the third embodiment, are structured as described above. Therefore, even if the contact terminals are changed in attitude in the housing by an external force, a preset amount (proper amount) of contact pressure is maintained between the spring contact and heater electrode. That is, even if the attitude of the connector terminal is forced to change in the housing, by an external force, the terminal pivotally moves about the protrusion, within the housing in an oscillatory manner. Therefore, it is ensured that the preset amount (proper amount) of contact pressure is maintained between the spring contact and the heater electrode.

Next, the fourth and fifth embodiments of the present invention are described regarding the connector. The fourth and fifth embodiments are different from the preceding embodiments only in the shape of the connector. Therefore, their description will concentrate on the difference between the connectors in the fourth and fifth embodiments, and the connectors in the preceding embodiments.

[Embodiment 4]

The connector in this embodiment is suitable for supplying electric power to a heater having an electrode on only one of its primary surfaces.

Figure 15:
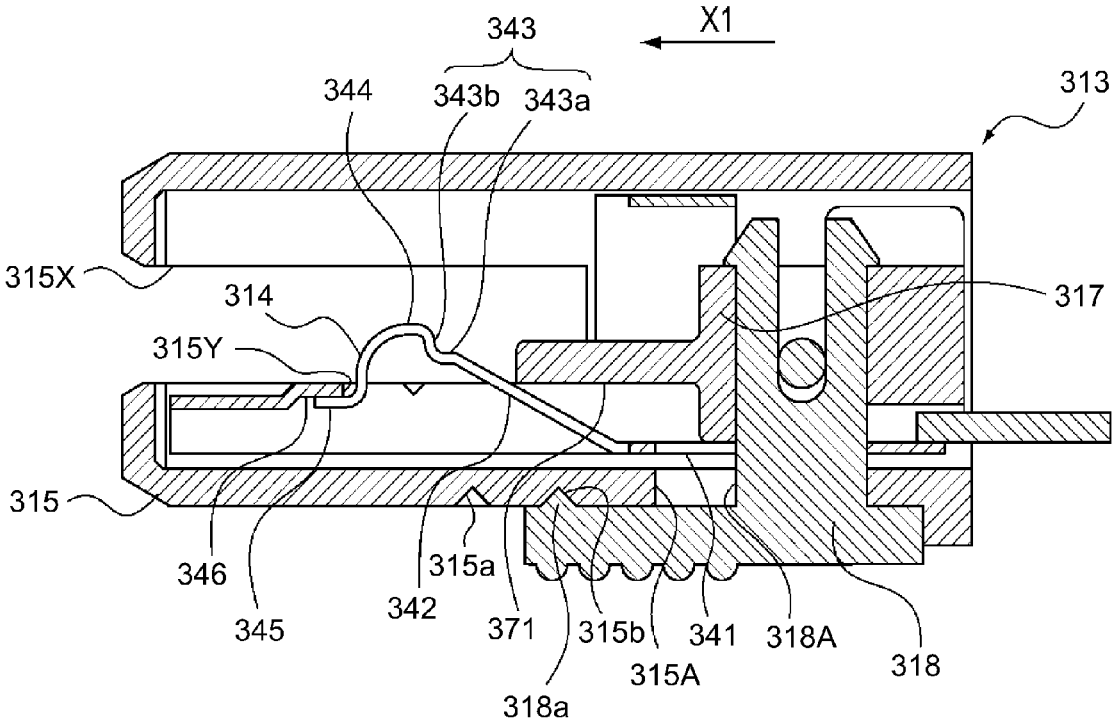
FIG. 15 is a sectional view of the connector in the fourth embodiment of the present invention, and shows the structure of the connector.

FIG. 15 is a sectional view of the connector 313 in this embodiment, and shows the structure of the connector 313. The connector 313 has a housing 315 and a terminal 314. The lateral walls of the housing 315 have a pair of slots 315X, one for one, into which a heater 305 shown in FIGS. 16(*a*)-16(*c*) fits. The terminal 314 is supported by the housing 315 in such a manner that it is allowed to move in an oscillatory manner. The housing 315 is roughly U-shaped in cross section; each of the lateral walls of the housing 315 is provided with the slot 315X. The bottom wall of the slot 315X is provided with a hole 315Y, through which a part of the terminal 314 is allowed to protrude into, or retract from, the slot 315X. Further, the housing 315 is provided with a catch (seat) 346 by which the tip 345 of the terminal 314 is caught. One side of the hole 315Y is the edge of the catch 345, and the other side of the hole 315Y is the edge of the pressing portion 371 of a regulating member 317 (which will be described later).

The connector 313 has the regulating member 317, which is within the housing 315. The regulating member 317 can be kept in a regulatory position (shown in FIG. 17) in which it keeps the terminal 314 retracted from the slot 315X, and a home position (shown in FIG. 15), into which the regulating member 317 is retracted, and in which the regulating member 317 does not regulate the terminal 314. The direction in which the regulating member 317 is movable is parallel to the direction (indicated by arrow mark X1 in FIG. 15, and the arrow mark X2 in FIG. 19) in which the heater enters the slot 315X when the connector 313 is engaged with the heater. The connector 313 is also provided with a controller 318 which is for moving the regulating member 317, or keeping the regulating member 317 locked in a specific position. The controller 318 is attached to the bottom surface of the housing 315. It is movable between the position shown in FIG. 15 and the position shown in FIG. 17, and can be placed in the position shown in FIG. 15, or the position shown in FIG. 17. The controller 318 is provided with a protrusion 318*a*, which is to fit into the recess 315*a* or 315*b*, with which the bottom surface of the housing 315 is provided, to regulate the position of the controller 318 in order to regulate thereby the position of the regulating member 317.

Figure 19:
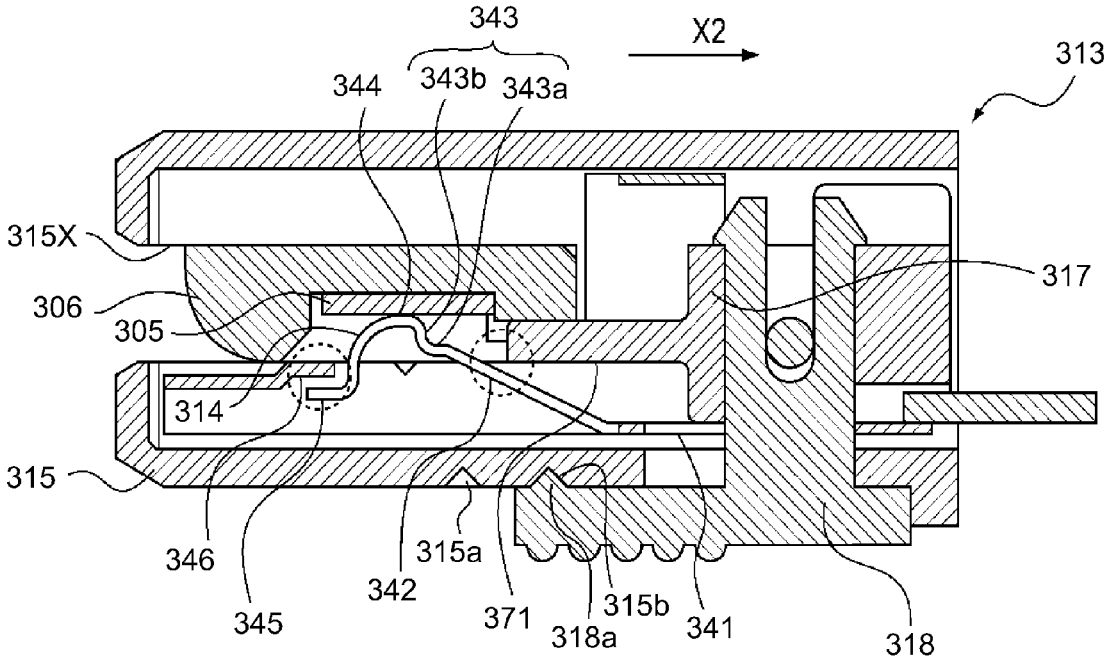
FIG. 19 is a sectional view of the combination of the connector, heater, and heater supporting member, in the fourth embodiment, after the terminal of the connector came into contact with the electrode of the heater.

The terminal 314 has a base portion 341, a flexible portion 342, a catch portion 343 (hook-shaped portion), a point 344 of contact, and the tip portion 345, disposed in this order from the side at which the terminal 314 is anchored to the bottom wall of the terminal 314. The terminal 314 is such a terminal that establishes an electrical connection between itself and the heater electrode 310 by being allowed to be moved into the slot 315X by its own resiliency. As the terminal 314 is allowed to move into the slot 315X, its point 344 of contact comes into contact with the electrode 310 of the heater 305. The point between the base portion 341 and flexible portion 342 functions as the pivot for the flexing of the terminal 314 (flexible portion 342). Referring to FIG. 15, the terminal 314 has the catch portion 343 (hook-shaped portion), which is on the downstream side of the point 344 of contact, in terms of the direction in which the heater 305 (object to be supplied with electric power) enters the slot 315X (FIG. 19). The catch portion 343 (hook-shaped portion) is between the point 344 of contact and the aforementioned pivot. The catch portion 343 is stair-like, having a roughly horizontal portion 343*a* and a roughly vertical portion 343*b*. The roughly horizontal portion 343*a* is roughly parallel to the direction indicated by the arrow mark X2 in FIG. 19, that is, the direction in which the heater 305 enters the slot 315X. The roughly vertical portion 343*b* is roughly vertical relative to the roughly horizontal portion 343*a*. The base portion 341 is the portion of the terminal 314, by which the terminal 314 is attached to the bottom wall of the terminal 314. The flexible portion 342 extends at a preset angle relative to the base portion 341. The terminal 314 is springy. Therefore, if it is subjected to a force which acts in the direction to cause the base portion 341 and the flexible portion 342 to form a straight line, it generates a reactive force in itself.

The point 344 of contact is curved. It establishes an electrical connection between itself and the electrode 310 of the heater 305 by coming into contact with the electrode 310 as the connector 313 is engaged with the heater 305. It is kept pressed upon the electrode 310 by the resiliency of the above-described flexible portion 342. The tip portion 345 is a portion of the terminal 314, which prevents the terminal 314 from shifting, by being caught by the catch portion 346 of the housing 315.

The material for the connector terminal 314 is stainless steel or titanium alloy. The surface of the terminal 314 is plated with gold or the like substance, which is low in electrical resistance.

The regulating member 317 is in the housing 315. It has the terminal pressing portion 371, which extends in the direction indicated by the arrow mark X1 in FIG. 17, that is, the direction in which the regulating member 317 is to be moved to regulate the terminal 314. As the regulating member 317 is pressed in the terminal regulating direction X1, it moves in the terminal regulating direction X1 while pressing downward the flexible portion 342 of the terminal 314, with the terminal pressing portion 371, until it reaches the hook-shaped catch portion 342. As soon as the pressing portion 371 of the regulating member 317 reaches the hook-shaped catch portion 343 (regulating position), the parallel portion 343*a* of the terminal 314 is pressed downward by the pressing portion 371 of the regulating member 317. Therefore, the terminal 314 is kept downwardly bent by the regulating member 317.

The regulating member 317 is solidly attached to the controller 318. The controller 318 is for moving the regulating member 317 in the regulating direction X1 or releasing direction X2. The controller 318, or the terminal controlling member, is provided with the protrusion 318*a*, which fits in the recess 315*a* or 315*b* of the housing 315. As the controlling member 318 is moved in the releasing direction X2 as far as it is allowed to move, the protrusion 318*a* fits into the recess 315*b*, allowing thereby the terminal 314 to protrude into the slot 315X so that as the connector 313 is engaged with the heater 305, the heater 105 enters the slot 315X and an electrical connection is established between the terminal 314 and the electrode 310 of the heater 305. On the other hand, as the controlling member 318 is moved in the regulating direction X1, its protrusion 318*a* fits into the recess 315*a*. When the protrusion 318*a* is in the recess 315*a*, the terminal 314 is outside the slot 315X (FIG. 17).

Figure 16:
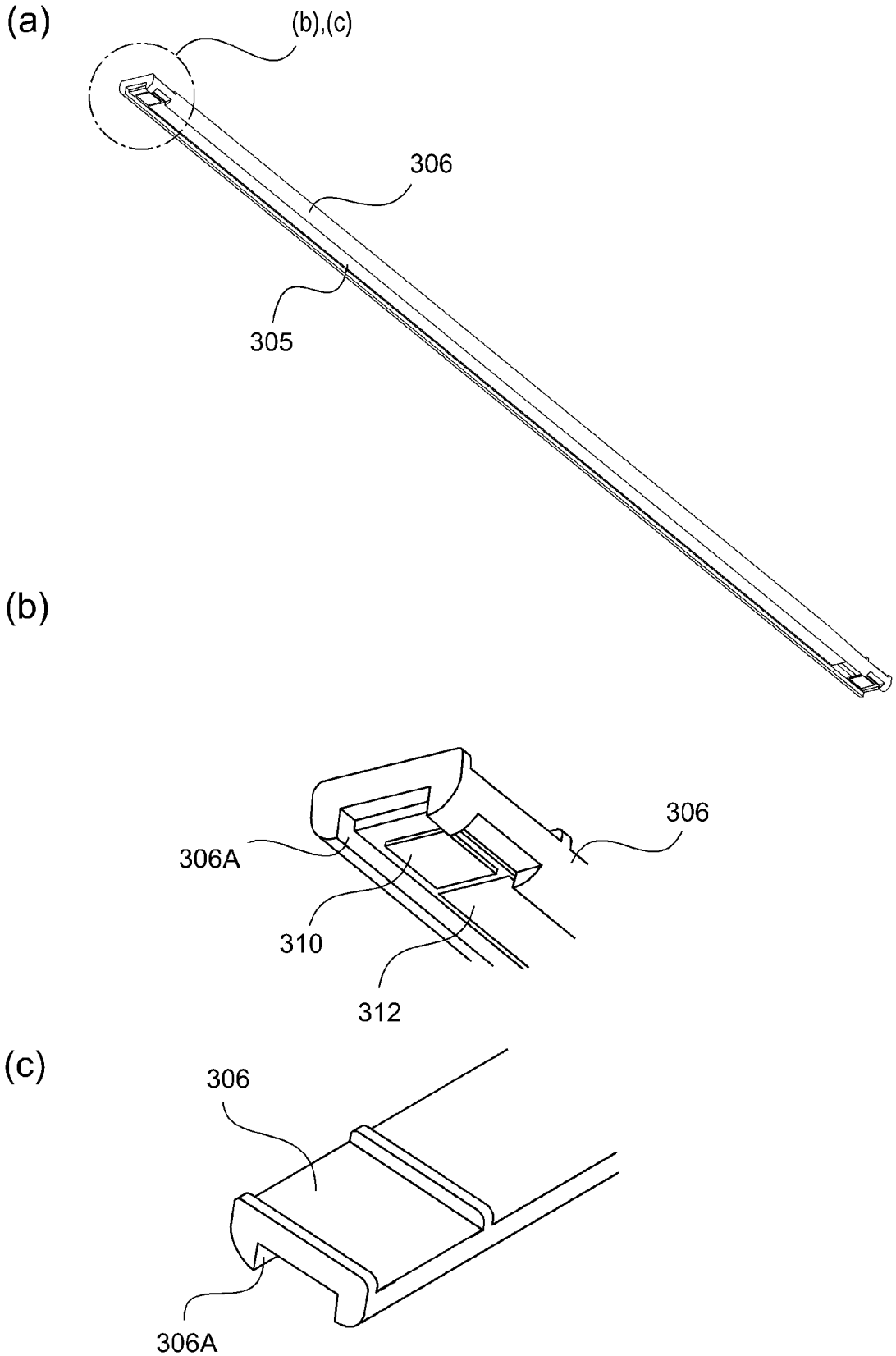
FIGS. 16(*a*)-(*c*) are a combination of drawings of the heater and the heater supporting member, which show the overall structure of the heater and the heater supporting member.

FIG. 16(*a*) is a perspective view of the combination of the heater 305 and the supporting member 306, and shows the overall structure of the combination. FIG. 16(*b*) is an enlarged perspective view of one of the lengthwise end portions of the combination of the heater 305 and the supporting member 306, as seen from the side on which the supporting member 306 (heater 305) contacts the film (endless belt). It shows the structure of the lengthwise end portion. FIG. 16(*c*) is an enlarged perspective view of one of the lengthwise end portion of the supporting member 306, and shows the structure of the end portion. Referring to FIGS. 16(*a*) and 16(*b*), the supporting member 306 is provided with a groove 306A, which extends in the lengthwise direction of the supporting member 306, and in which the heater 305 is supported. The supporting member 306 plays the role of regulating the film 7 in position while the film 7 is circularly moved.

Figure 17:
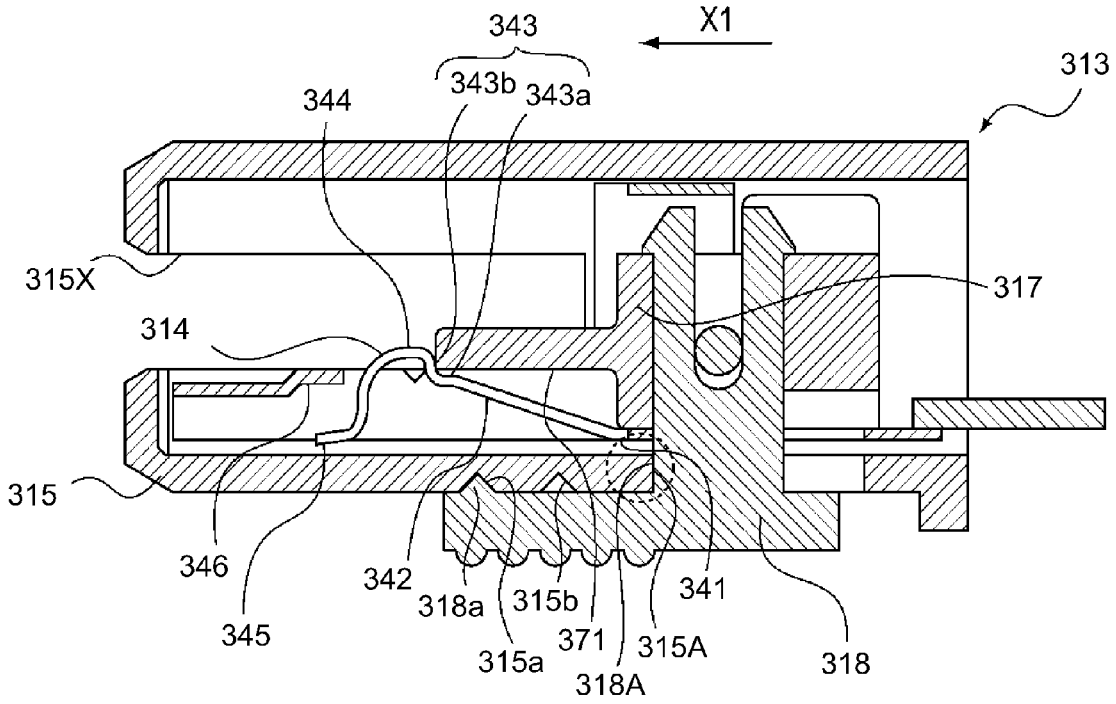
FIG. 17 is a sectional view of the connector in the fourth embodiment, and shows the structure of the connector.
Figure 18:
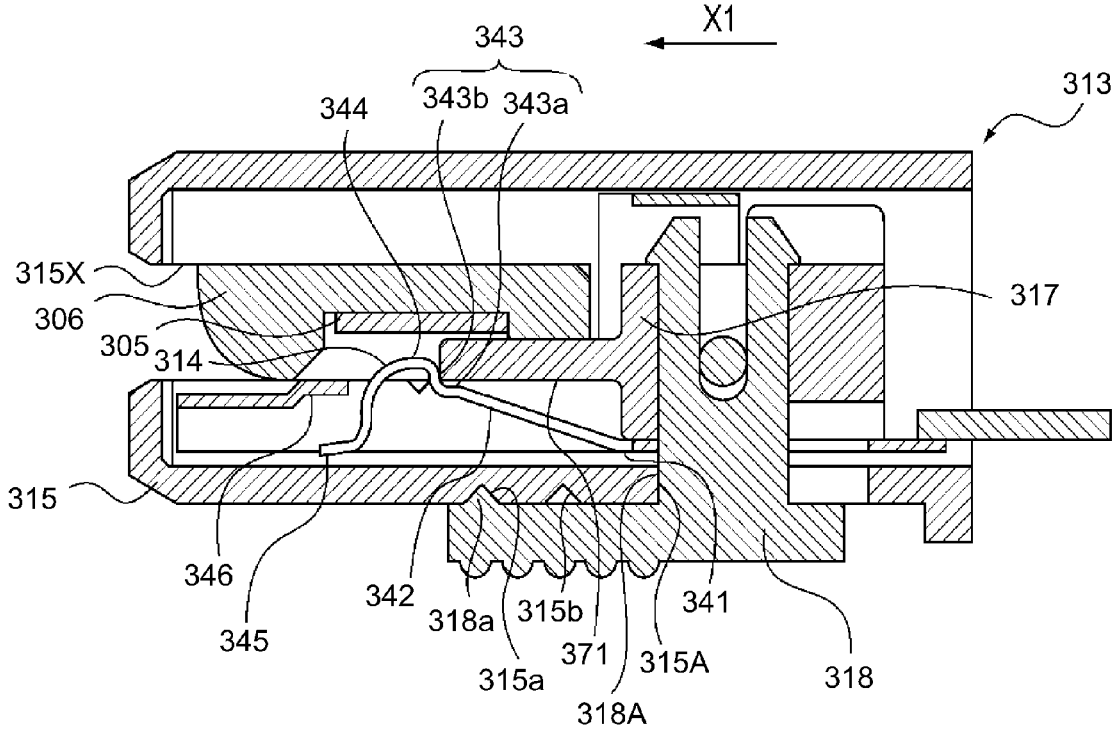
FIG. 18 is a sectional view of the combination of the connector, heater, and heater supporting member, in the fourth embodiment, before the terminal of the connector was allowed to come into contact with the electrode of the heater.

Next, referring to FIGS. 17, 18, and 19, how the connector 313 is to be engaged with the supporting member 306 (heater 305) is described.

FIG. 17 is a sectional view of the connector 313, and shows the structure of the connector 313. Before a user of the image forming apparatus engages the connector 313 with the supporting member 306, which is supporting the heater 305, the user moves the regulating member 317 from its position shown in FIG. 15 to the position shown in FIG. 17, by manipulating the controller 318. As the controller 318 is manipulated as described above, the regulating member 317 moves toward the slot 315X of the housing 315, in the direction X1.

While the regulating member 317 is moved into the slot 315X, the pressing portion 371 of the regulating member 317 comes into contact with the flexible portion 342 of the terminal 314 and continues to press the flexible portion 342 downward, bending thereby the terminal 314 downward. As the regulating member 317 is moved further in the direction X1, the pressing portion 371 comes into contact with the catch portion 343 (hook-shaped portion). Meanwhile, the pressing portion 371 remains in contact with the parallel portion 343*a*. Then, as the controller 318 is moved as far as it can be moved in the direction X1, that is, until the front surface 318A of the controller 318 (FIG. 15) in terms of the direction X1 comes into contact with the deepest end 315A (vertical edge in FIG. 4) of the slot 315X of the housing 315, the pressing portion 371 of the regulating member 317 is caught by the catch portion 343 of the terminal 314.

The connector 313 and its terminal 314 are structured so that while the pressing portion 371 is in contact with the horizontal portion 343*a*, the horizontal portion 343*a* remains roughly parallel to the direction X1 in which the pressing portion 371 is moved to regulate the terminal 314. Therefore, the regulating member 317 can be smoothly moved, that is, without being hung up by the terminal 314. As described above, the catch portion 343 has not only the horizontal portion 343*a*, but also, the vertical portion 343*b*, which is between the horizontal portion 343*a* and the point 344 of contact. The vertical portion 343*b* plays also a role of preventing the point 344 of contact from coming into contact with the pressing portion 371.

FIG. 18 is a sectional view of the combination of the connector 313, the heater 305, and the supporting member 306 before the release of the terminal 314 by the regulating member 317 after the engagement of the connector 313 with the supporting member 306 (heater 305). It shows the structure of the connector 313 and the supporting member 306. The connector 313 is attached to the supporting member 306, which is supporting the heater 305, as shown in FIG. 18, with the terminal 314 being kept pressed downward so that the terminal 314 remains in the state shown in FIG. 17. That is, before the connector 313 is attached to the supporting member 306, the terminal 314 is bent downward by the regulating member 317 in such a manner that it remains downwardly bent while the connector 313 is attached to the supporting member 306. Therefore, the catch portion 343 and the point 344 of contact of the terminal 314 do not come into contact with the heater 305 (more specifically, electrode 310).

FIG. 19 is a sectional view of the combination of the connector 313, heater 305, and the supporting member 306 after the release of the terminal 314 by the regulating member 317 after the engagement of the connector 313 with the supporting member 306 (heater 305). It shows the structure of the connector 313 and the supporting member 306. After the connector 313 is engaged with the supporting member 306, which is supporting the heater 305, as shown in FIG. 18, the controller 318 is to be operated so that the regulating member 317 is moved in the terminal releasing direction X2, that is, the opposite direction from the direction in which the regulating member 318 is moved toward the slot 315X of the housing 315, as shown in FIG. 19. As the controller 318 is moved in the above-described direction, the catch portion 343 of the terminal 314, which was kept downwardly pressed by the pressing portion 371 of the regulating member 317, is released by the pressing portion 371, allowing thereby the point 344 of contact to virtually vertically move upward and come into contact with the electrode 310 of the heater 305. After the point 344 of contact comes into contact with the electrode 310, there is a gap (encircled with dotted line in FIG. 19) between the flexible portion 342 of the terminal 314 and the pressing portion 371 of the regulating member, and there is a gap (encircled by dotted line in FIG. 19) between the tip portion 345 of the terminal 314 and the catch portion 346 of the housing 315. Thus, the point 344 of contact is allowed to remain in contact with the electrode 310 while maintaining a preset amount of contact pressure between itself and the electrode 310.

In this embodiment, the terminal 314 is pressed downward, and kept downwardly bent, by the regulating member 317. However, the connector 313 may be structured so that the terminal 314 can be pressed down, and kept downwardly bent, by a special tool; it does not need to have the regulating member 317 and the controller 318. In such a case, all that is necessary is to press downward the horizontal portion 343a of the terminal 314 with the special tool. More specifically, in a case where the connector is structured so that a special tool is used to downwardly bend the contact terminal, the housing 315 is provided with the second opening which allows the special tool to be inserted into the slot 315X, from the opposite direction from the direction in which the heater 305 enters the slot 315X. With the provision of the second opening, the special tool can be insert into the slot 315X to downwardly press the horizontal portion 343*a* of the catch portion 343 (hook-shaped portion) to bend the terminal 314 downward in order to move the point 344 of contact out of the slot 315X.

In this embodiment, the connector 313 is engaged with the supporting member 306 which is supporting the heater 305, while the terminal 314 is kept downwardly bent by the pressing portion 371 of the regulating member 317 (or the special tool), which presses downward the horizontal portion 343*a* of the catch portion 343 of the terminal 314. Therefore, while the connector 313 is engaged with the supporting member 306, a gap is present between the point 344 of contact and the heater 305, and therefore, the point 344 of contact and heater 305 do not rub against each other. Therefore, the heater electrode 310 and/or the point 344 of contact of the terminal 314 of the connector 313 is not frictionally worn during the engagement or disengagement of the connector 313. Therefore, an unsatisfactory electrical connection between the connector 313 and heater electrode 310, which is attributable to repeated engagement or disengagement of the connector 313, is unlikely to occur.

Further, the connector terminal 314 is provided with the hook-shaped portion (catch portion). Therefore, the amount by which the terminal 314 is bent downward by the regulating member 317 or special tool remains accurate. Therefore, it is ensured that the point 344 of contact of the terminal 314 of the connector 313 is not frictionally worn when the connector 313 is engaged with the heater 305.

[Embodiment 5]

The connector in this embodiment is suitable for supplying electric power to a two-sided heater, that is, a heater which has a heater (or heaters) and electrodes, on both surfaces of its ceramic substrate.

Figure 20:
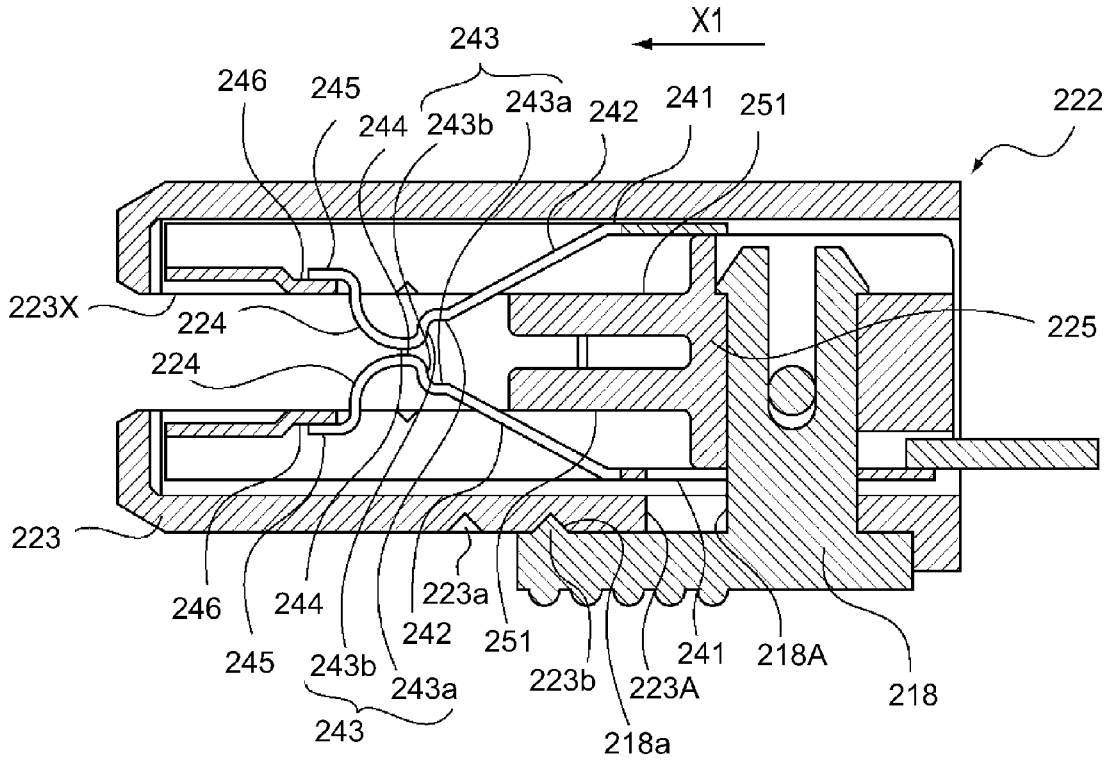
FIG. 20 is a sectional view of the connector in the fifth embodiment of the present invention, and shows the structure of the connector.

Referring to FIG. 20, the connector 222 in this embodiment is provided with a pair of terminals 224, which are positioned in the housing 223 of the connector 222, in such a manner that the two points 244 of contact, one for one, of the pair of terminals 224 oppose each other in the slot 223X. As the supporting member 221, which is supporting the heater 220 (FIG. 22) enters the slot 223X, one of the pair of terminals 223 comes into contact with the electrode on one of the two primary surfaces of the ceramic substrate of the heater 220, and the other terminal 223 comes into contact with the electrode on the other primary surface. The detail of the engagement between the connector 222 and the supporting member 221 of the heating unit is as follows.

FIG. 20 is a sectional view of the connector 222, and shows the structure of the connector 222. The connector 222 has a housing 223, a pair of terminals 224, a regulating member 225, and a controller 218. The housing 223 has a slot 223X, between its roughly U-shaped lateral walls.

The connector terminal 224 has: a base portion 241 by which the terminal 224 is held to the housing 223; a flexible portion 242 for providing the terminal 224 with resiliency; a catch portion 243 (hook-shaped portion); a point 244 of contact with curvature, and the tip portion 345, disposed in this order from the side at which the terminal is held to the housing 223. The housing 223 is provided with a catch 246, by which the tip portion 245 is caught. The catch portion 243 has a horizontal portion 243*a* and a vertical portion 243*b*. These portions of the contact terminal 224 are the same in function as the counterparts of the contact terminal 314 in the above-described fourth embodiment.

The connector 222 in this embodiment is also structured so that the point 244 of contact of one of the spring contacts of the terminal 224 opposes the other of the spring contacts. Thus, it is desired to prevent the problem that the plating of the point 244 of contact is changed in condition by the contact between the opposing two points 244 of contact. Therefore, the connector 222 is structured so that when the connector 222 is not in engagement with the heater 220 (as shown in FIG. 20), a gap is maintained between the two points 244 of contact.

The regulating member 225 has two pressing portions 251, that is, the top and bottom pressing portions. The top pressing portion 251 presses the top terminal 224, and the bottom pressing portion 251 presses the bottom terminal 224.

Figure 21:
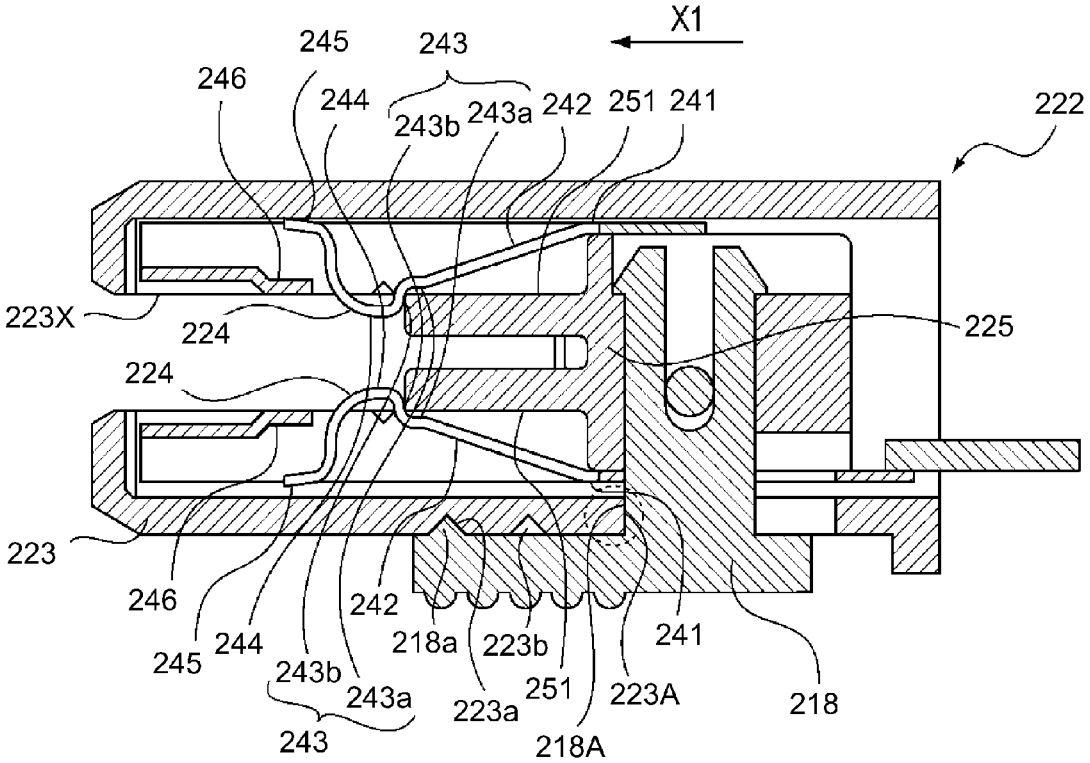
FIG. 21 is a sectional view of the connector in the fifth embodiment, when the connector is ready to be engaged with the heater and heater supporting member. It shows the structure of the connector.

FIG. 21 is a sectional view of the connector 222 when the connector 222 is ready to be engaged with the heater 220. It also shows the structure of the connector 222. Referring to FIG. 21, before a user of the image forming apparatus engages the connector 222 with the supporting member 221 which is supporting the heater 220, the user moves the regulating member 225 from its position shown in FIG. 20 to the position shown in FIG. 21, by manipulating the controller 218. As the controller 218 is manipulated as described above, the regulating member 225 moves toward the slot 223X between the U-shaped lateral walls of the housing 223. While the regulating member 225 is moved into the slot 223X between the U-shaped lateral portions of the housing 223, the top and bottom pressing portions 251 come into contact with the flexible portion 242 of the top terminal and that of the bottom terminal, respectively, and continue to press the flexible portions 242, bending thereby the terminals upward and downward, respectively. As the regulating member 225 is moved further, the top and bottom pressing portions 251 come into contact with the catch portions 243 (hook-shaped portion) of the top and bottom terminals 224. Then, as the controller 218 is moved as far as it can be moved, that is, until the front surface 218A of the controller 218 comes into contact with the vertical edge 223A (encircled by dotted line in FIG. 21) of the slot 223X of the housing 223, the pressing portion 251 of the regulating member 225 is caught by the catch portion 243 of the terminal 224, whereby the regulating member 225 is stopped.

Figure 22:
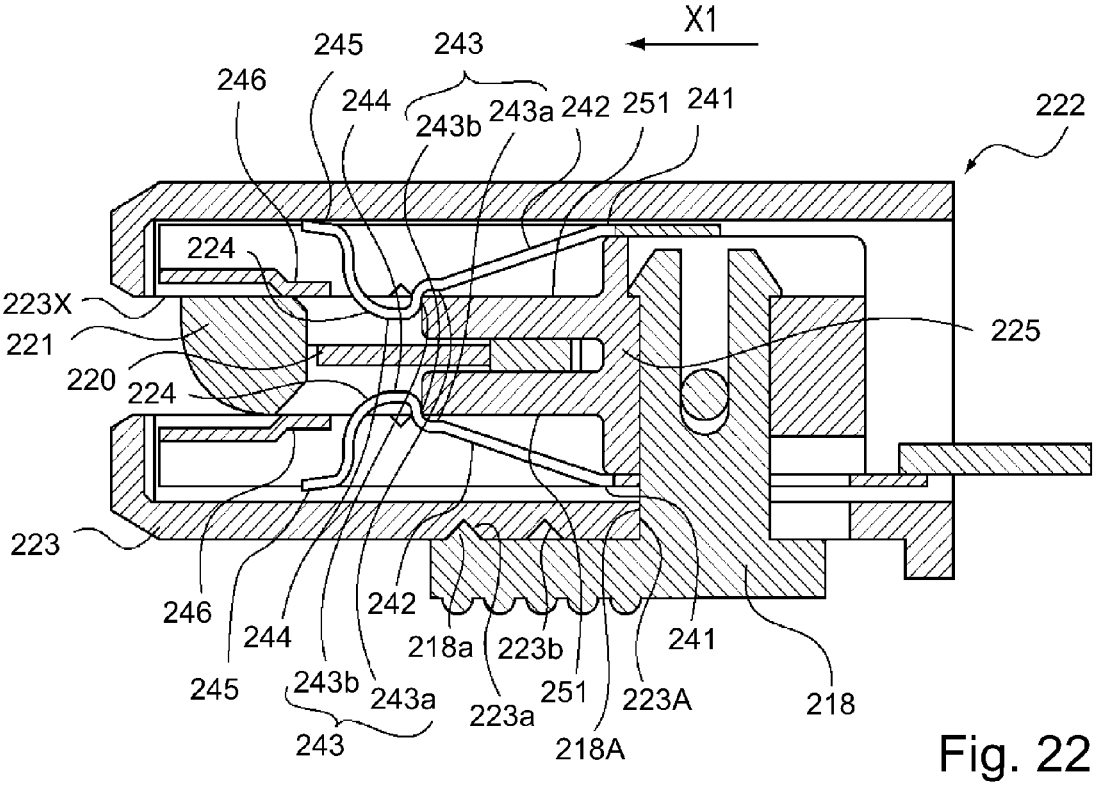
FIG. 22 is a sectional view of the combination of the connector, heater, and heater supporting member, in the fifth embodiment, when the connector is in engagement with the heater and heater supporting member, but the connector terminal is yet to be allowed to come into contact with the heater electrode. It shows the structure of the connector.

FIG. 22 is a sectional view of the combination of the connector 222, the heater 220, and the supporting member 221 before the controller 218 is returned to its home position. It shows the structure of the combination. Referring to FIG. 22, the connector 222 is engaged with the supporting member 221, which is supporting the heater 220. Immediately after the engagement of the connector 222, there still remains a preset amount of gap between the point 244 of contact of the terminal 224 and the corresponding electrode of the heater 220.

Figure 23:
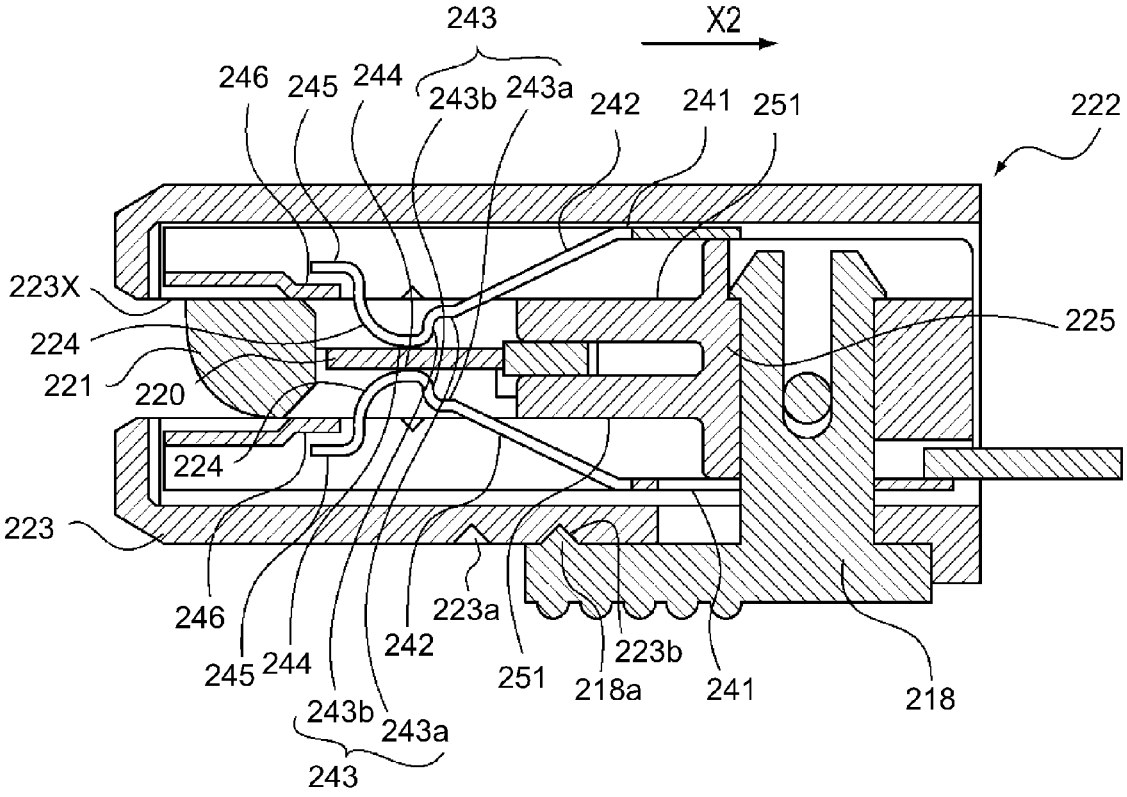
FIG. 23 is a sectional view of the combination of the connector, heater, and heater supporting member, in the fifth embodiment of the present invention, when the connector terminal is in full engagement with the heater electrode. It shows the structure of the connector.

FIG. 23 is a sectional view of the combination of the connector 222, the heater 220, and the supporting member 221 after the completion of the process of engaging the connector 222 with the supporting member 221. Referring to FIG. 23, the regulating member 225 is to be moved in the release direction X2 by the manipulation of the controller 218. As the regulating member 225 is moved in the release direction X2, the top and bottom pressing portions 251 of the regulating member 225 disengage from the catch portion 243 of the top and bottom terminals 224, allowing thereby the point 244 of contact of the top terminal 224 and the point 244 of contact of the bottom terminal 224 to come into contact with the top and bottom electrodes of the heater 220, respectively, in the direction which is roughly perpendicular to the heaters 220.

In this embodiment, the connector 222 is engaged with the supporting member 221, which is supporting the heater 220, while the top and bottom terminals 224 are kept downwardly and upwardly bent by the top and bottom pressing portions 251, respectively, of the regulating member 225. Therefore, while the connector is engaged with the supporting member 221, a gap is present between the point 244 of contact and the electrode of the heater 220, and therefore, the point 244 of contact and the electrode of the heater 220 do not rub against each other. Therefore, the point 244 of contact is not frictionally worn. Therefore, an unsatisfactory electrical connection between the connector 222 and the heater electrode 220, which is attributable to the frictional wear of the point 244 of contact does not occur.

In the fourth and fifth embodiments, the connectors 313 and 222, respectively, are structured so that before the connectors 313 and 222 are engaged with the heater 305 and 220, the terminals 314 and 224 can be regulated by the regulating member or a special tool. Therefore, it does not occur that the points 344 and 244 of contact of the terminals 314 and 224 come into contact with the supporting members 306 and 221, respectively. Therefore, the phenomenon that the terminals 314 and 224 are permanently deformed by a substantial amount of load to which the points 344 and 244 of contact of the terminals 314 and 224 are subjected when the terminals 314 and 224 are engaged with the supporting members 306 and 221, respectively, and/or the phenomenon that the points 334 and 244 of contact are frictionally worn when the terminals 314 and 224 are engaged with the supporting members 306 and 221, respectively, does not occur. Therefore, a proper amount of contact pressure is generated and maintained between the points 334 and 244 of contact and the electrodes of the heaters 305 and 220, respectively.

Further, the terminals 314 and 224 are provided with a hook-shaped portion. Therefore, the amount by which they are resiliently bent by the regulating member or special tool is accurate. Therefore, it is ensured that the point of contact is not frictionally worn when the connector is engage with the heater.

Further, because the connectors in the fourth and fifth embodiments are structured as described above, a disassembler of the heating unit can disengage the connectors 313 and 222 without allowing the points 344 and 244 of contact to rub against the electrodes when the disassembler disassembles or reassemble the heating unit. Therefore, a reassembled connector is virtually the same in condition in terms of the electrical connection as it was before it was disassembled. That is, the connectors do not need to be adjusted in the state of electrical connection related to the performance of a fixing device, and therefore, are easier to maintain than a conventional connector.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 109321/2012, 109322/2012 and 265482/2012 filed May 11, 2012, May 11, 2012 and Dec. 4, 2012, respectively, which are hereby incorporated by reference.

What is claimed is:

1. An image fixing apparatus for heating and fixing an unfixed image formed on a recording material, comprising:

a heater including a substrate, a first electrode provided on one side of said substrate and a second electrode provided on the other side of the substrate; and a connector, connected to said heater, configured to supply electric power, said connector including an electrically insulative housing, and a contact terminal provided inside said housing and having first spring contact contacted to said first electrode and a second spring contact contacted to said second electrode, wherein said contact terminal is movable relative to said housing in an urging direction of said spring contacts.

2. An apparatus according to claim 1, further comprising a holder configured to hold said heater through which said connector is connected to said heater.

3. An apparatus according to claim 1, wherein said contact terminal is movable in a range of 0.3 mm-1.5 mm.

4. An apparatus according to claim 1, wherein said first and second spring contacts are line-symmetrically shaped.

5. An apparatus according to claim 1, wherein said housing is provided with a projection configured to prevent said contact terminal from coming out of said housing.

6. An apparatus according to claim 1, further comprising an endless belt heatable by said heater, wherein the unfixed image is heated through said endless belt.

7. An electrical connector for supplying an electric power to a heater, said connector comprising:

electrically insulative housing; and a contact terminal provided inside said housing and including a first spring contact for contacting to a first electrode provided on one side of the heater and a second spring contact for contacting to a second electrode provided on the other side of the heater, wherein said contact terminal is movable relative to said housing in an urging direction of said spring contacts.

8. A connector according to claim 7, wherein said contact terminal is movable in a range of 0.3 mm-1.5 mm.

9. A connector according to claim 7, wherein said first and second spring contacts are line-symmetrically shaped.

10. A connector according to claim 7, wherein said housing is provided with a projection configured to prevent said contact terminal from coming out of said housing.

11. An image fixing apparatus for heating and fixing an unfixed image formed on a recording material, comprising:

a heater including a substrate, and an electrode provided on said substrate;

a connector, connected to said heater, configured to supply electric power, said connector including an electrically insulative housing, a contact terminal provided inside said housing and having a spring contact contacted to said electrode, and a regulating member pressing said spring contact in a direction opposite a spring urging direction of said spring contact, wherein said regulating member is movable between a first position pressing said spring contact and a second position retracting relative to the first position.

12. An apparatus according to claim 11, wherein said contact terminal includes a second spring contact opposed to said spring contact, wherein said regulating member presses said first and second spring contacts at the first position.

13. An apparatus according to claim 11, further comprising an endless belt heatable by said heater, wherein the unfixed image is heated through said endless belt.

14. An electrical connector for supplying an electric power to a heater, said connector comprising:

electrically insulative housing;

a contact terminal provided inside said housing and including a spring contact configured to contact an electrode of a heater; and a regulating member configured to press said spring contact in a direction opposite a spring urging direction of said spring contact, wherein said regulating member is movable between a first position pressing said spring contact and a second position retracting relative to the first position.

15. A connector according to claim 14, wherein said contact terminal includes a second spring contact opposed to said spring contact, wherein said regulating member presses said first and second spring contacts at the first position.

* * * * *